US010881208B2

(12) United States Patent
Yajima et al.

(10) Patent No.: US 10,881,208 B2
(45) Date of Patent: Jan. 5, 2021

(54) CHAIR AND SEAT SUPPORT MECHANISM

(71) Applicant: KOKUYO CO., LTD., Osaka (JP)

(72) Inventors: Toshiki Yajima, Osaka (JP); Takao Sugano, Osaka (JP); Yasuhiro Shibamoto, Osaka (JP); Fei Xu, Osaka (JP)

(73) Assignee: KOKUYO CO., LTD., Osaka (JP)

( * ) Notice: Subject to any disclaimer, the term of this patent is extended or adjusted under 35 U.S.C. 154(b) by 86 days.

(21) Appl. No.: 16/078,788

(22) PCT Filed: Feb. 23, 2016

(86) PCT No.: PCT/JP2016/055313

§ 371 (c)(1),
(2) Date: Aug. 22, 2018

(87) PCT Pub. No.: WO2017/145271

PCT Pub. Date: Aug. 31, 2017

(65) Prior Publication Data

US 2019/0045928 A1 Feb. 14, 2019

(51) Int. Cl.
*A47C 1/024* (2006.01)
*A47C 3/026* (2006.01)
(Continued)

(52) U.S. Cl.
CPC ..... *A47C 1/024* (2013.01); *A47C 3/026* (2013.01); *A47C 3/0257* (2013.01); *A47C 7/004* (2013.01); *A47C 7/006* (2013.01)

(58) Field of Classification Search
CPC ..... A47C 3/026; A47C 3/0257; A47C 1/022; A47C 1/024; A47C 7/004; A47C 7/006
(Continued)

(56) References Cited

U.S. PATENT DOCUMENTS 3,873,054 A * 3/1975 McKee ..... A47C 3/025 248/371
4,183,492 A * 1/1980 Meiller ..... B60N 2/02 248/395
(Continued)

FOREIGN PATENT DOCUMENTS

CA 3009482 A1 * 8/2017 ..... A47C 7/004
CA 3025250 A1 * 12/2017 ..... A47C 3/18
(Continued)

OTHER PUBLICATIONS

Office Action dated Oct. 1, 2019, issued in counterpart JP application No. 2018-501455, with English translation. (12 pages).
(Continued)

*Primary Examiner* — Robert Canfield
(74) *Attorney, Agent, or Firm* — Westerman, Hattori, Daniels & Adrian, LLP

(57) ABSTRACT

A chair includes a support mechanism 2 interposed between a leg 1 and a seat 3, wherein the support mechanism 2 is arranged below the seat 3, is configured to each individually and movably support the seat 3, at least at two locations in a front-rear direction and two locations in a left-right direction, along a predetermined trajectory, and the support mechanism 2 includes: a seat inclining mechanism Q or a seat inclining function configured to downwardly incline a tip side in a movement direction of the seat 3 in accordance with movement of the seat 3, and further includes: a center-of-gravity movement mechanism P or a return-force generation mechanism configured to generate a return force in a direction of returning the seat 3 having moved from a reference position (S) in a front-rear or left-right direction, to the reference position (S) by using a center-of-gravity movement.

20 Claims, 34 Drawing Sheets

(51) Int. Cl.
*A47C 7/00* (2006.01)
*A47C 3/025* (2006.01)

(58) Field of Classification Search
USPC ..... 297/311, 313, 314
See application file for complete search history.

(56) References Cited

U.S. PATENT DOCUMENTS

| | | | | | |
|---|---|---|---|---|---|
| 4,575,151 | A * | 3/1986 | Edstrom | A47C 3/026 | 297/302.6 |
| 5,397,163 | A * | 3/1995 | Puerner | A47C 3/0255 | 248/370 |
| 5,409,295 | A * | 4/1995 | Edstrom | A47C 3/0255 | 248/372.1 |
| 5,590,930 | A | 1/1997 | Glockl | | |
| 6,206,335 | B1 * | 3/2001 | Huber | A47C 21/006 | 248/601 |
| 8,439,442 | B2 * | 5/2013 | Highlander | A47C 7/14 | 297/302.7 |
| 8,613,482 | B2 * | 12/2013 | Ni | A47C 1/026 | 297/302.1 |
| 10,272,282 | B2 * | 4/2019 | Harlow | A63B 21/1609 | |
| 10,499,752 | B2 * | 12/2019 | Palmnas | F25D 11/02 | |
| 2005/0280301 | A1 * | 12/2005 | Freed | A47C 9/002 | 297/337 |
| 2009/0261642 | A1 * | 10/2009 | Dickie | A47C 7/446 | 297/314 |
| 2015/0343924 | A1 * | 12/2015 | Takeuchi | B60N 2/39 | 297/314 |
| 2016/0081478 | A1 * | 3/2016 | Ehrenleitner | F16M 11/24 | 297/314 |
| 2019/0208910 | A1 * | 7/2019 | Sugano | A47C 3/026 | |
| 2019/0343286 | A1 * | 11/2019 | Sugano | A47C 3/026 | |
| 2020/0085195 | A1 * | 3/2020 | Shibamoto | A47C 7/024 | |

FOREIGN PATENT DOCUMENTS

| | | | | | |
|---|---|---|---|---|---|
| CA | 3026413 | A1 * | 12/2017 | A47C 3/026 | |
| CA | 3044170 | A1 * | 6/2018 | A47C 3/026 | |
| DE | 19915003 | A1 | 10/2000 | | |
| DE | 20 2007 016488 | U1 | 2/2008 | | |
| DE | 202017102909 | U1 * | 4/2018 | A47C 1/03261 | |
| EP | 593881 | A1 * | 4/1994 | | |
| EP | 3345507 | A1 * | 7/2018 | | |
| EP | 3345508 | A1 * | 7/2018 | | |
| EP | 3473135 | A1 * | 4/2019 | | |
| JP | 7-139 | U | 1/1995 | | |
| JP | H07-503392 | A | 4/1995 | | |
| JP | 10-66629 | A | 3/1998 | | |
| JP | 10-513374 | A | 12/1998 | | |
| JP | 2004-8440 | A | 1/2004 | | |
| JP | 2006-20952 | A | 1/2006 | | |
| JP | 2012-10938 | A | 1/2012 | | |
| JP | 2018099338 | A * | 6/2018 | A47C 3/0257 | |
| JP | 2019037383 | A * | 3/2019 | | |
| WO | 2009/059602 | A2 | 5/2009 | | |
| WO | WO-2017221312 | A1 * | 12/2017 | A47C 3/0255 | |

OTHER PUBLICATIONS

Extended (Supplementary) European Search Report dated Sep. 13, 2019, issued in counterpart EP application No. 16891428.1. (8 pages).
International Search Report dated May 17, 2016, issued in counterpart International Application No. PCT/JP2016/055313 (2 pages).
Office Action dated May 12, 2020, issued in counterpart JP Application No. 2018-501455, with English translation (10 pages).
Office Action dated Jul. 9, 2020, issued in counterpart CA Application No. 3,009,482 (4 pages).

* cited by examiner

CHAIR AND SEAT SUPPORT MECHANISM

TECHNICAL FIELD

The present invention relates to a chair suitably applicable to an office rotating chair and the like.

BACKGROUND ART

Conventionally, chairs, especially office rotating chairs, with an aim that a seated person can maintain a comfortable sitting posture for a long time in an office, at home or the like, have been widely devised (for example, see Patent Document 1).

These office rotating chairs are configured so that a seat and a backrest can be tilted in accordance mainly with a rearward inclining and forward inclining movement of the seated person and are configured so that the seat and the backrest can be fixed in a position allowing for realization of a required posture of the seated person, so that an operation allowing the seated person to feel comfort while proceeding a work is possible.

Even though, from an outside perspective, it may appear as if a seated person sitting on an office rotating chair for a long time normally rests in a posture in which the person feels comfort, it has become clear that the person actually moves a lumbar region, a gluteal region and further femoral region from the required posture all the time to maintain a comfortable sitting posture on the office rotating chair.

Specifically, even though many seated persons appear, at first glance, to rest in a sitting posture that is comfortable for the persons, it has been seen that the persons actually maintain comfort by the persons' own sitting, while moving, in any direction, that is, in a front-rear direction and a left-right direction with respect to the planar direction, a position of the lumbar region and the gluteal region as the center in planar view, in a posture that is generally comfortable. Additionally, it has become evident that in a state in which such an operation can be performed smoothly, the seated persons feel no discomfort, and further, the state contributes to improving efficiency of work to be done during sitting.

Therefore, it should be understood that present chairs are required to be equipped with a function that allows for a suitable support for the above-described behavior by the seated persons.

An example of chairs having a concept close to such a concept includes a chair including a seat support mechanism as mentioned in Patent Document 2.

CITATION LIST

Patent Literature

Patent Document 1 Japanese Unexamined Patent Application Publication No. 2012-010938

Patent Document 2: Japanese Unexamined Patent Application Publication (Translation of PCT Application) No. 10-513374

SUMMARY OF THE INVENTION

Problem to be Solved by the Invention

However, in the support mechanism of Patent Document 2, while a seated person moves a center of gravity to the front, rear, right, and left, a falling moment exerted on a supporting post further increases due to the seat pivoting around the lower end being a fulcrum, and thus, the seated person needs to brace his/her feet to the floor to rest in a proper posture. In addition, the same behavior is performed even when the seat is toppled in any direction of the front, rear, right, and left directions, and then the support mechanism may be suitable for a stool; however, in an office chair, a body movement of the seated person is usually different between the front and the rear, and the body movement of the seated person is also usually different between the front-rear and the left-right. Thus, it would be difficult to say that it is possible to provide supports properly corresponding to the body movement of the seated person.

Further, when the seated person braces his/her feet to the floor, if a lower end of a leg is supported by a caster, the caster may run in an unexpected direction, making a stable use of the chair difficult. In particular, the seat only performs a pivotal operation via the supporting post around the lower end being a fulcrum, and therefore, a seat pivotal trajectory is not accorded with a movement below the knees of the seated person, resulting in an undesirable support state in which the feet get stuck when the seat inclines forward.

Further, the support mechanism has a structure in which the supporting post descends and the lower end thereof comes in contact with the floor when the seated person sits down on the chair, and thus, there is inconvenience in that the seat sinks every time the persons sits down, leading to a problem that the floor can easily be damaged when the supporting post swings while being in contact with the floor.

An object of the present invention is to solve the problems described above, and an object thereof is to provide a chair that allows for a proper support corresponding to a body movement of a seated person, allows for a stable use even in a subsequent posture reached after changing an initial posture to move the center of gravity, allows, as a result, the seated person to perceive a comfortable sitting feeling, even if sitting for a long time, and further allows the seated person to stably maintain a high work efficiency.

Means for Solving the Problem

The present invention adopts the following means in order to achieve such an object.

That is, a chair according to the present invention comprises: a leg erected on a floor surface; a seat arranged above the leg; and a support mechanism interposed between the leg and the seat, wherein the support mechanism is arranged below the seat, is configured to movably support the seat at least at two locations in a front-rear direction and two locations in a left-right direction, along a predetermined trajectory, comprises: a seat inclining function configured to downwardly incline a tip side in a movement direction of the seat in accordance with movement of the seat from a predetermined reference position, and further comprises: a return-force generation mechanism configured to generate, in accordance with an amount of movement, a return force in a direction of returning, to the reference position, the seat having moved in a front-rear or left-right direction from the reference position.

That is, the inventors of the present application could contemplate the present invention by focusing for the first time on the following advantage that a seated person moves his/her lumbar region, gluteal region, and femoral region to the front, rear, right, and left by a predetermined dimension around a reference position being a center at which the seated person his/herself sits, and when the seat is inclined while the seat is moved horizontally during the movement and further, when the seat is operated so that a backswing force that causes the chair to return to the reference position is naturally obtained, as a result of which it is possible to improve the comfort of the seated person to make the seated person less exhausted while improving work efficiency. Here, the "predetermined trajectory" indicates a trajectory along which a certain location of the seat can be continuously operated on an operation surface where a horizontal movement amount, a seat surface inclination angle, and an up-down movement amount are associated. A comprehensive example of the certain location includes a position of the center of gravity, but a position other than the center of gravity is also possible. In other words, in accordance with an operation of the seat along the predetermined trajectory, a unique up-down movement amount and seat surface inclination angle respectively determined by a position of the seat in planar view are set, and the seat will be repeatedly and continuously guided to these positions.

Such a configuration not only can suitably maintain a posture of the seated person during sitting, but also can suitably support the movement of the seated person during sitting. Specifically, even if the seated person moves the center of gravity to the front, rear, right, and left, as long as the center of gravity of the seat is located between supporting locations arranged at two locations in the front-rear direction, or as long as the center of gravity of the seat is located between supporting locations arranged at two locations in the left-right direction, it is easy to design so that no large falling moment is exerted on a support mechanism, and thus, it is possible to reduce a need for the seated person to brace his/her feet to the floor to rest in a proper posture. In addition, it is possible to provide, without a backlash, a trajectory appropriate for each of the front-rear direction and the left-right direction, and thus, even if, such as in an office chair, the body movement of the seated person is different between the front and the rear, or even if the body movement of the seated person is different between the front-rear and the left-right, it is still possible to realize a support state properly corresponding to the body movement of the seated person.

Further, it is not highly necessary for the seated person to brace his/her feet to the floor to assure balance, and thus, even if a lower end of the leg is supported by a caster, a risk of the caster running in an unexpected direction can be reduced, allowing for stable use of the chair. In particular, the seat supported by the above-described support mechanism can be configured not to perform a monotonous pivotal operation around a certain fulcrum close to the floor, and thus, the pivotal trajectory of the seat can be accorded with the movement below the knees of the seated person, as a result of which it is easy to realize a proper support state in which the feet do not get stuck even when inclining forward.

Further, with such a support mechanism, there is no problem that the seat and the leg sink down every time the seated person sits down, and there is no inconvenience caused as in the case where the lower end of a supporting post comes in contact with the floor for pivoting.

Thus, in the chair of the present invention, when a seat surface inclines, the seat moves in a direction of the inclination, and thus, it is possible to configure a chair that extraordinarily well fits to the body movement of the seated person, and that, in view of a tendency of movement resulting from a human body structure of the seated person during sitting, can suitably support such a movement. As a result, according to the present invention, it is possible to provide a chair in which the seated person can perceive a comfortable sitting feeling even if sitting for a long time, and a high work efficiency can stably be maintained.

Further, a return force works which attempts to return the seat to the reference position in accordance with the movement of the seat, and thus, the seated person can perceive a pleasant feeling with a gentle motion as if sitting on a rocking chair.

When a lifting up and down mechanism of the seat is adopted, in order to provide a compact configuration instead of a complicated structure where the support mechanism is merged with the lifting up and down mechanism, it is preferable that the leg includes the lifting up and down mechanism, the seat is arranged above the lifting up and down mechanism, and the support mechanism is interposed between the lifting up and down mechanism and the seat.

Further, the support mechanism is desirably supported by an independent support structure in each of at least the front-rear direction and the left-right direction along a predetermined trajectory so that each of the forward, backward, rightward, and leftward operations of the seat can be performed more smoothly.

In order to ensure that the operation of the seat is properly adapted to the movement of the seated person, it is suitable that an operation angle and an operation distance of the seat in the front-rear direction are set so as to be larger than those in the left-right direction or those in a rear direction are set to be larger than those in a front direction.

Here, the operation angle and the operation distance signify a maximum inclination angle and a maximum movement distance within an operation range, respectively. Hereinafter, the same applies.

In order to realize the return-force generation mechanism with a simpler configuration, it is preferable to construct the return for generation mechanism, as a center-of-gravity movement mechanism configured to elevate a center of gravity of the seat in accordance with the operation of the seat from the reference position. In this case, the generated return force changes in accordance with a body weight of the seated person, and thus, it is possible to obtain a suitable return force for the seated person. That is, a small return force is obtained for a light body weight and a great return force is obtained for a heavy body weight.

Further, it is desirable to provide a rotation support mechanism configured to rotatably support the seat in a horizontal direction relative to the leg so that the seat can more suitably follow the movement of the seated person during work.

For a specific configuration in which a comfortable sitting posture of the seated person can be maintained, it is desirable that the support mechanism includes a front-rear support unit configured to operatively support the seat in the front-rear direction and a left-right support unit configured separately from the front-rear support unit and configured to operatively support the seat in the left-right direction, and that the return-force generation mechanism includes a front-rear return unit configured to generate a return force in the front-rear direction and a left-right return unit configured separately from the front-rear return unit and configured to generate a return force in the left-right direction.

In order to make a whole chair more compact in planar view, it is desirable that the front-rear support unit and the left-right support unit are arranged to overlap at an overlapping position in planar view.

Further, in order to set a lowest height of the seat of the chair to be lower, it is preferable that the front-rear support unit and the left-right support unit are arranged to overlap in an up-down direction.

Considering the behavior of the seated person performing a greater and more frequent operation in the front-rear direction than that in the left-right direction, it is preferable that the front-rear support unit is arranged above the left-right support unit and is positioned closer to the seated person.

It is preferable to attach the backrest to the front-rear support unit so that the tilting mechanism of the backrest can be configured with a simple configuration and the backrest can follow more naturally the movement of the seated person.

In order to configure the support mechanism that can perform a precise and stable operation, it is preferable that the support mechanism includes a guide surface formed along a predetermined trajectory and a follower configured to perform a relative operation following the guide surface.

In order to ensure that any undesirable "fear" or discomfort is not inflicted on the seated person due to an abrupt operation of the seat, it is desirable that the support mechanism includes a slowing portion configured to slow an operation of the follower in accordance with its closeness to an operation end of the follower.

Further, in order to ensure that any undesirable shock or noise due to the abrupt operation of the seat is not inflicted on the seated person, it is desirable that the support mechanism includes a shockless unit configured to avoid or absorb a shock caused by a collision between an end of the guide surface and the follower at the operation end.

In order to realize a smooth operation in accordance with the movement of the seated person, it is preferable that the support mechanism includes a link member in which the operation end is operable along a predetermined trajectory.

In order to realize a simple movement of the chair, it is desirable that the leg includes a caster configured to rollably contact a floor surface. That is, as in Japanese Unexamined Patent Application Publication (Translation of PCT Application) No. 10-513374, if in the chair, an element that grips the floor surface due to a frictional force during sitting contacts the floor surface, there is a problem that the person cannot move while seated. In contrary thereto, in the present invention, it is less likely that a horizontal force is exerted on the caster even if the seat is in an inclined state during sitting, and thus no other elements are needed which generate the frictional force onto the floor surface, as a result of which the seated person can move while seated when necessary.

In order to realize the above-described behavior of the seat with the support mechanism alone, it is effective that the support mechanism: is configured to move the supporting locations to the seat to the front, rear, right, and left by combining a front support structure and a rear support structure configured to directly or indirectly support a bottom surface of the seat at least at two locations in the front-rear direction and a left support structure and a right support structure configured to directly or indirectly support the bottom surface of the seat at two locations in the left-right direction, the supporting locations being configured to draw a trajectory along which a tip side in a movement direction of the seat is downwardly inclined in accordance with the movement; and further comprises a return-force generation mechanism configured to generate, in accordance with the amount of the movement, a return force in a direction of returning the supporting locations to the seat having moved from the reference position in the front-rear or left-right direction, to the reference position.

Examples of specific modes of an implementation include that which includes a slowing portion configured to slow an operation in accordance with its closeness to the tip side in the movement direction of the seat and that which includes a shockless unit configured to absorb a shock between members at the operation end of the seat.

Effect of the Invention

With the above-described configuration, the present invention can provide a chair in which the seated person can perceive a comfortable sitting feeling even if sitting for a long time, and a high work efficiency can stably be maintained.

MODE FOR CARRYING OUT THE INVENTION

Figure 1:
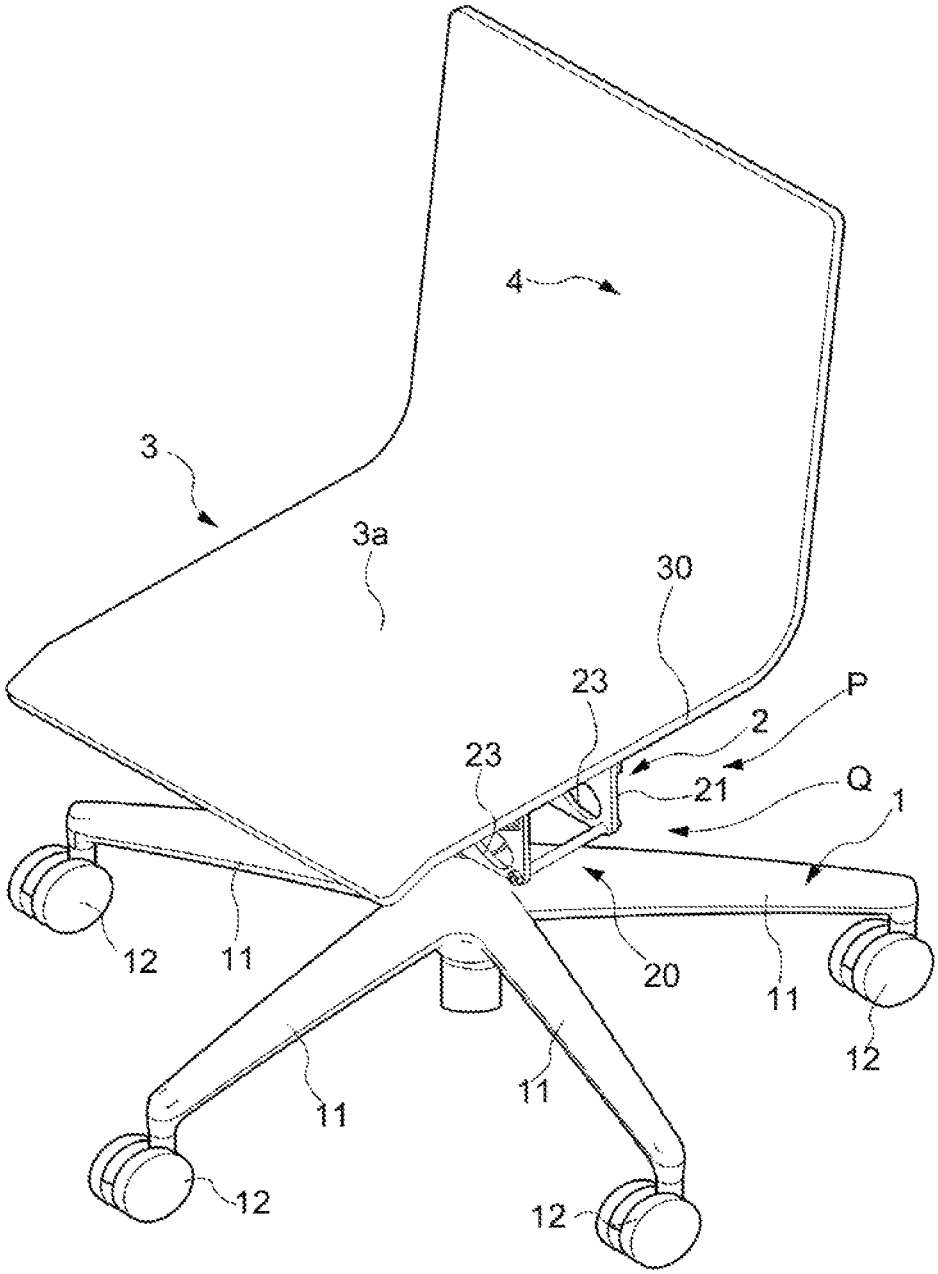
FIG. 1 is an appearance diagram according to a first embodiment of the present invention.
Figure 2:
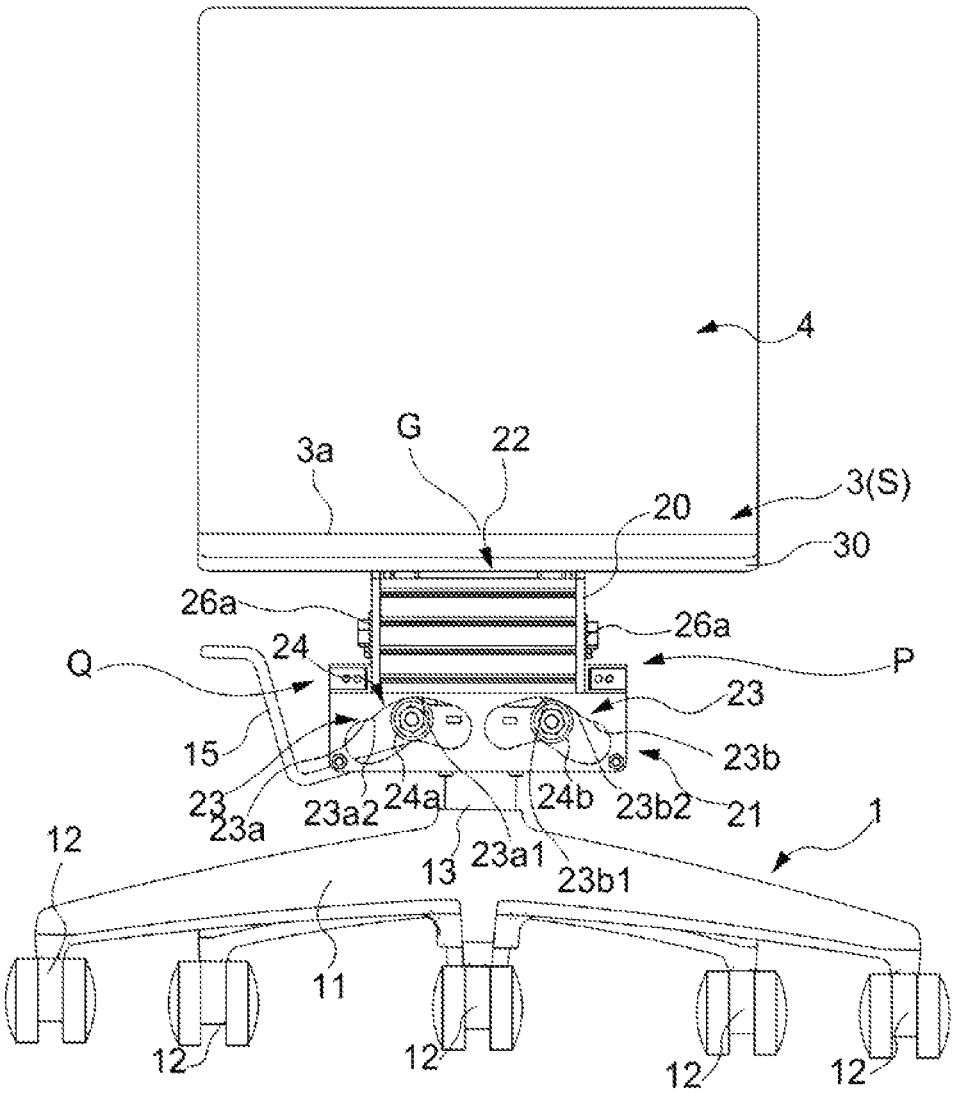
FIG. 2 is a front view according thereto.
Figure 3:
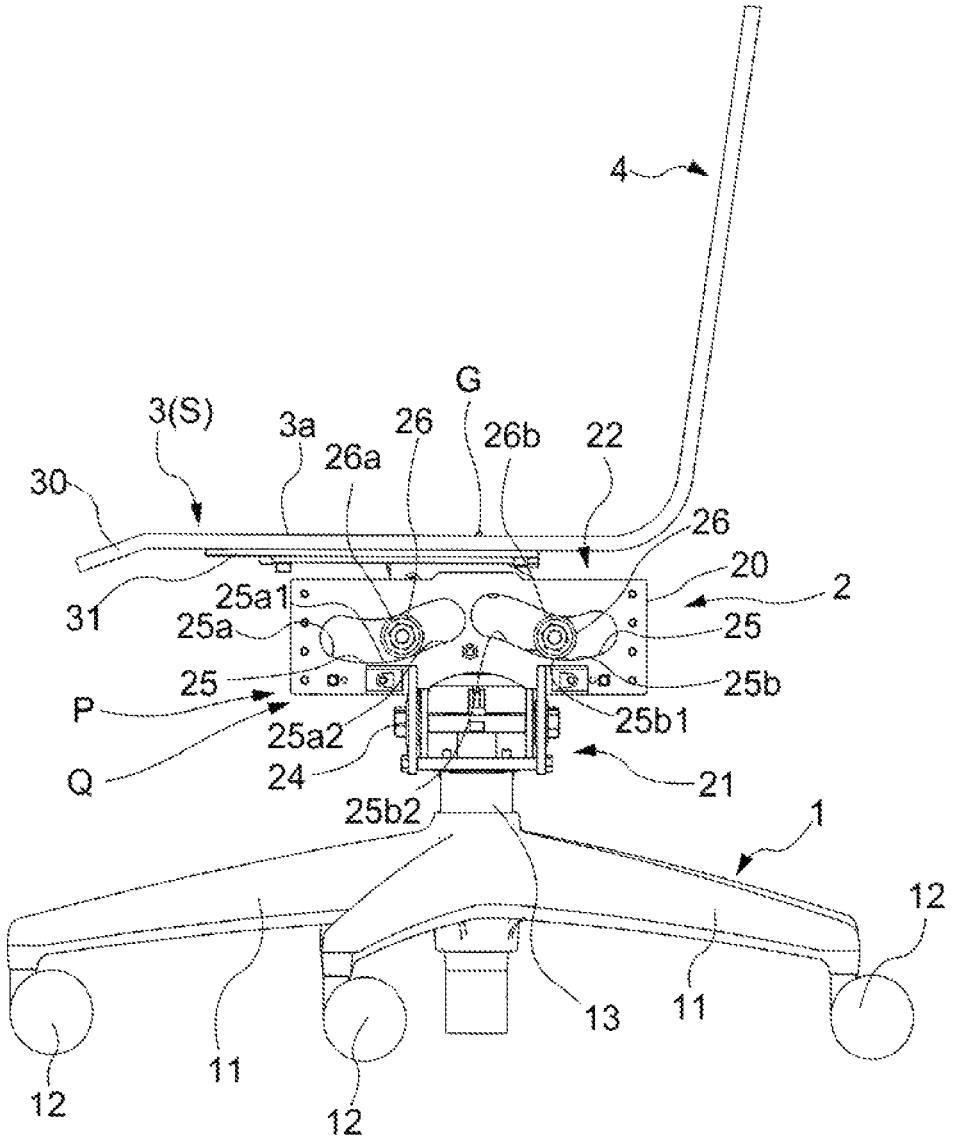
FIG. 3 is a side view according thereto.
Figure 4:
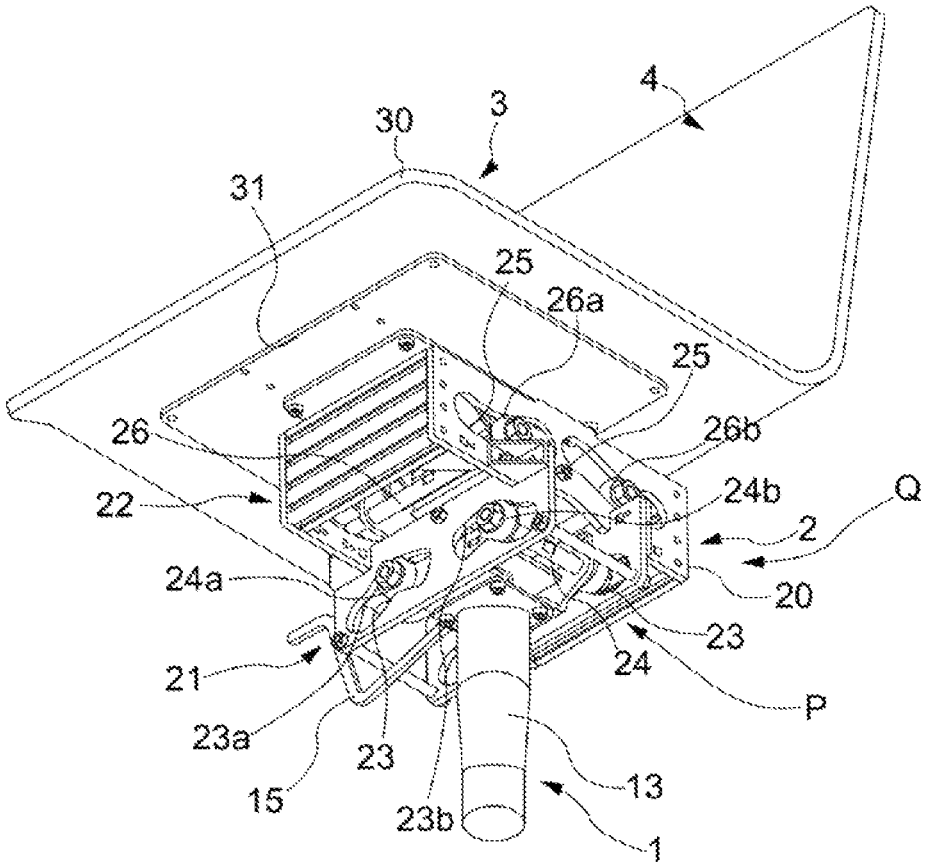
FIG. 4 is a perspective view of main parts according thereto.
Figure 5:
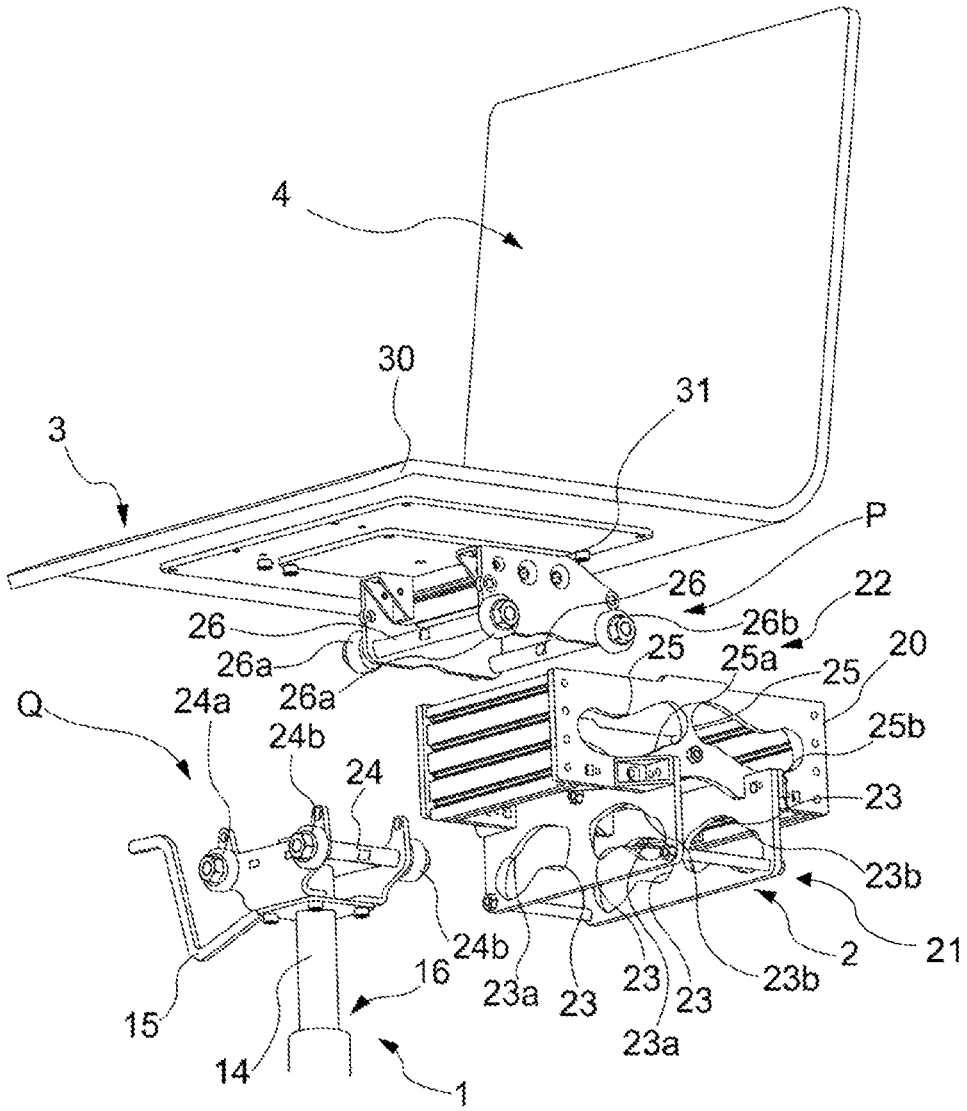
FIG. 5 is an exploded perspective view thereof.
Figure 6:
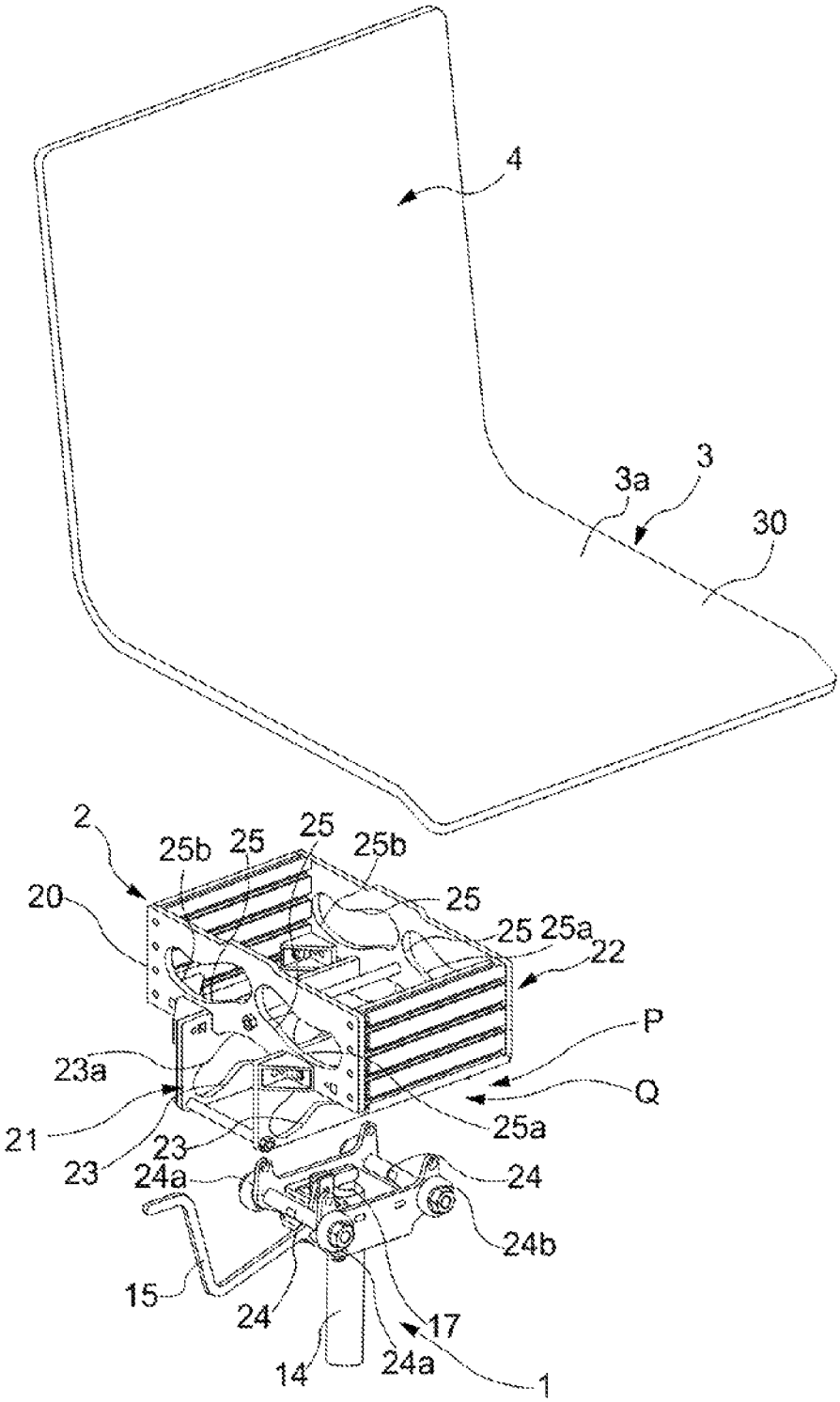
FIG. 6 is an exploded perspective view thereof.

Each of embodiments of the present invention will be described below with reference to the drawings.

First Embodiment

A chair according to a first embodiment of the present invention is referred to as an office rotating chair that can suitably be used in an office or at home.

As illustrated in FIG. 1 to FIG. 8, the chair mainly includes: a leg 1 erected on a floor surface, a seat 3 arranged above the leg 1, and a backrest 4 formed integrally with the seat 3.

The leg 1 includes a leg vane 11 formed radially in plan view; a caster 12 attached to a bottom side of the leg vane 11 and roll ably contacting the floor surface; a leg supporting post 13 erected on a center of the leg vane 11; a gas spring 14 being a lifting up and down mechanism mounted within the leg supporting post 13 and configured to support the seat 3 in a lifting up and down manner, a rotation support mechanism 16 configured to support, in the vicinity of an upper end of the leg supporting post 13, the seat 3 to permit horizontal rotation by allowing a rod of the gas spring 14 to relatively rotate with respect to the leg supporting post 13; and an operation lever 15 configured to adjust a vertical position of the seat 3 by pressing a push button 17 arranged at an upper end of the gas spring 14 to extend and shrink the gas spring 14.

In the present embodiment, the seat 3 is constructed mainly of a seat main body 30 of a plate shape formed integrally with the backrest 4, where a top surface of the seat main body 30 is a seat surface 3*a*, and a seat receiver 31 for supporting the seat 3 from below is attached on a bottom surface side of the seat main body 30.

Here, in a chair according to the present embodiment, a support mechanism 2 interposed between the leg 1 and the seat 3 is arranged below the seat 3, is configured to movably support the seat 3, at least at two locations in a front-rear direction and two locations in a left-right direction, along a predetermined trajectory, includes a seat inclining mechanism Q being a seat inclining function configured to downwardly incline a tip side in a movement direction of the seat 3 in accordance with movement of the seat 3, and further includes a return-force generation mechanism configured to generate, in accordance with an amount of movement, a return force in a direction of returning the seat 3 having moved from a reference position (S) in the front-rear or left-right direction, to the reference position (S).

That is, to realize the above-described behavior of the seat 3 with the support mechanism 2 alone, the support mechanism 2 according to the present embodiment: is configured to move the supporting locations to the seat 3 to the front, rear, right, and left by combining a front support structure and a rear support structure configured to directly or indirectly support the bottom surface of the seat 3 at least at two locations in the front-rear direction and a left support structure and a right support structure configured to directly or indirectly support the bottom surface of the seat 3 at two locations in the left-right direction, the supporting locations being configured to draw a trajectory along which the tip side in a movement direction of the seat 3 is downwardly inclined in accordance with the movement; and further includes a center-of-gravity movement mechanism P described later being a return-force generation mechanism configured to generate, in accordance with the amount of movement, the return force in the direction of returning the supporting locations to the seat 3 having moved from the reference position (S) in the front-rear or left-right direction, to the reference position (S). A configuration of the support mechanism 2 will be described specifically below.

As illustrated in FIG. 1 to FIG. 6, the support mechanism 2 in the present embodiment includes guide surfaces 23*a*, 23*b*, 25*a*, and 25*b* interposed between the leg 1 and the seat 3 and formed along a predetermined trajectory for moving the seat 3 in the front-rear direction and the left-right direction and followers 24*a*, 24*b*, 26*a*, and 26*b* configured to perform a slide operation following the guide surfaces 23*a*, 23*b*, 25*a*, and 25*b*, and operatively supports the seat 3 by a relative operation of the guide surfaces 23*a*, 23*b*, 25*a*, and 25*b* and the followers 24*a*, 24*b*, 26*a*, and 26*b*.

The support mechanism 2 is configured from an upper end portion of the leg 1 to a lower end portion of the seat receiver 31. Specifically, the support mechanism 2 is configured by the upper end portion of the leg 1, the lower end portion of the seat receiver 31, and a support housing 20 interposed between the upper end portion of the leg 1 and the lower end portion of the seat receiver 31. In the support, mechanism 2, a pair of left-right support units 21 in the front-rear direction configured to operatively support the seat 3 in the left-right direction is configured over the upper end portion of the leg 1 and a lower half region of the support housing 20, and a pair of front-rear support units 22 in the left-right direction configured to operatively support the seat 3 in the front-rear direction is configured over the lower end portion of the seat receiver 31 and an upper half region of the support housing 20. That is, the left-right support units 21 and the front-rear support units 22 overlap at an overlapping position in planar view are configured respectively independently as a separate body. In the present embodiment, the front-rear support units 22 directly supports the seat 3 configured integrally with the backrest 4, and thus, in the present embodiment, a configuration in which the backrest 4 is indirectly attached to the front-rear support unit 22 is adopted, and needless to say, a configuration in which the backrest 4 is directly attached in a region of the upper half portion of the support housing 20 shall not be precluded.

The left-right support unit 21 is for supporting the seat 3 so that the seat 3 is inclinable at 3.4° in the left-right direction, and includes a left-right guide hole 23 formed in the lower half region of the support housing 20 and a left-right support axis 24 formed at the upper end of the leg 1, where the both ends of the left-right support axis 24 are inserted in the left-right guide hole 23. At both ends in the front and rear direction of the left-right support axis 24, a left follower 24*a* and a right follower 24*b* configured to operate smoothly within the left-right guide hole 23 are arranged. Surfaces in contact with the left follower 24*a* and the right follower 24*h* in the left-right guide hole 23 correspond to a left guide surface 23*a* and a right guide surface 23*b*. The left guide surface 23*a* and the right guide surface 23*b* form an upward curved shape to run along a previously set predetermined trajectory. That is, in the present embodiment, the left support structure is configured by the left guide surface

23*a* and the left follower 24*a*. Further, the right support structure is configured by the right guide surface 23*b* and the right follower 24*b*.

In the present embodiment, the upward curved shape is divided into first regions 23*a*1 and 23*b*1 designated as a constant operation range including the reference position (S) and second regions 23*a*2 and 23*b*2 designated as a range reaching a vicinity of an operation end beyond the operation range. It is so set that in the first regions 23*a*1 and 23*b*1, through a collaboration with the followers 24*a* and 24*b*, while a center-of-gravity movement in a height direction of the seat 3 is suppressed (accordingly, while a return force to the reference position (S) is suppressed) and while an inclination angle of the seat 3 is suppressed, the seat 3 is guided in a direction away from the reference position (S), and when the second regions 23*a*2 and 23*b*2 are reached, through a collaboration with the followers 24*a* and 24*b*, while the center-of-gravity movement in the height direction of the seat 3 is increased (accordingly, while a return force to the reference position (S) is increased) and while the inclination angle of the seat 3 is increased, the seat 3 is guided in the direction away from the reference position (S). That is, in the present embodiment, the slowing portion is so configured that a mobility of the seat 3 is gradually slowed down by an increase in return force, as the followers 24*a* and 24*b* follow from the first regions 23*a*1 and 23*b*1 to the second regions 23*a*2 and 23*b*2. In other words, the slowing portion includes the first regions 23*a*1 and 23*b*1 and the second regions 23*a*2 and 23*b*2. The first regions 23*a*1 and 23*b*1 and the second regions 23*a*2 and 23*b*2 are continuous, and thus, it is difficult to clearly indicate a boundary position; however, a position at which a center-of-gravity movement rate in the height direction of the seat 3 is changed from low to high may be considered as the boundary position.

It is noted that, in the present embodiment, at an operation end located at a left end of the left-side guide hole 23 and an operation end located at a right end of the right-side guide hole 23, when the seat 3 is changed steeply in a lifted direction while keeping the inclination angle of the seat constant, a shockless unit R is configured which ensures that the left follower 24*a* and the right follower 24*b* make practically little or no contact with both left and right end surfaces of the left-right guide holes 23. As a result, a collision between the left follower 24*a* and the right follower 24*b*; and the end surface of the left-right guide holes 23 at the operation end can be avoided. It is noted that, the left-right guide holes 23 may be arranged continuously and integrally.

The front-rear support unit 22 is arranged above the left-right support unit 21 and is positioned closer to the seated person to more easily react to the movement of the seated person. The front-rear support unit 22 is configured to support the seat 3 so that the seat 3 can be inclined at 8° forward and at 10° rearward and includes front-rear guide holes 25 formed in the upper half region of the support housing 20 and a front-rear support axis 26 formed at the lower end of the seat receiver 31, where the both ends are inserted in the front-rear guide holes 25. The front follower 26*a* and the rear follower 26*b* configured to move smoothly within the front-rear guide holes 25, are arranged at both left and right ends of the front-rear support axis 26. Surfaces in contact with the front follower 26*a* and the rear follower 26*b* in the front-rear guide holes 25 correspond to the front guide surface 25*a* and the rear guide surface 25*b*. The front guide surface 25*a* and the rear guide surface 25*b* form an upward curved shape to run along a previously set predetermined trajectory. That is, in the present embodiment, the front support structure is configured by the front guide surface 25*a* and the front follower 26*a*. Further, the rear support structure is configured by the rear guide surface 25*b* and the rear follower 26*b*.

In the present embodiment, the upward curved shape is divided into first regions 25*a*1 and 25*b*1 designated as a constant operation range including the reference position (S) and second regions 25*a*2 and 25*b*2 designated as a range reaching a vicinity of an operation end beyond the operation range. It is so set that in the first regions 25*a*1 and 25*b*1, through a collaboration with the followers 26*a* and 26*b*, while a center-of-gravity movement in a height direction of the seat 3 is suppressed. (accordingly, while a return force to the reference position (S) is suppressed) and while an inclination angle of the seat 3 is suppressed, the seat 3 is guided in a direction away from the reference position (S) and when the second regions 25*a*2 and 25*b*2 are reached, through a collaboration with the followers 26*a* and 26*b*, while the height direction of the seat 3 is increased (accordingly, while a return force to the reference position (S) is increased) and while the inclination angle of the seat 3 is increased, the seat 3 is guided in the direction away from the reference position (S). That is, in the present embodiment, the slowing portion is so configured that a mobility of the seat 3 is gradually slowed down by an increase in return force, as the followers 28*a* and 26*b* follow from the first regions 25*a*1 and 25*b*1 to the second regions 25*a*2 and 25*b*2. In other words, the slowing portion includes the first regions 25*a*1 and 25*b*1 and the second regions 25*a*2 and 25*b*2. The first regions 25*a*1 and 25*b*1 and the second regions 25*a*2 and 25*b*2 are continuous, and thus, it is difficult to clearly indicate a boundary position; however, a position at which a center-of-gravity movement rate in the height direction of the seat 3 is changed from low to high may be considered as the boundary position.

It is noted that, in the present embodiment, at the front-rear operation ends of the front-rear guide holes 25, when the seat 3 is changed steeply in a lifted direction while keeping the inclination angle of the seat constant, the shockless unit R is configured which absorbs a shock so that the front follower 26*a* and the rear follower 26*b* make no contact with front-rear both end surfaces of the front-rear guide holes 25. As a result, a collision between the front follower 26*a* and the rear follower 26*b*; and the end surface of the front-rear guide holes 25 at the operation end can be avoided. It is noted that, the front-rear guide holes 25 may be arranged continuously and integrally.

To specifically describe a front-rear operation of the seat 3, when the seat 3 at the reference position (S) swings forward, the rear follower 26*b* follows the upwardly inclined first region 25*b*1, and at the same time, the front follower 26*a* follows the downwardly inclined first region 25*a*1. As a result, little return force is exerted on the forward operation of the seat 3, in the vicinity of the reference position (S). Afterward, when the seat 3 operates further forward from the reference position (S), each of the front and rear followers 26*a*, 26*b* approaches the upwardly inclined second regions 25*a*2 and 25*b*2, the return force increases as a degree of elevation of a center of gravity G of the seat 3 increases. In the vicinity of the operation end, when the inclination degree is further increased to practically seldom reach the operation end, the shockless unit R is formed. In other words, the shockless unit R is for avoiding a shock caused by a collision between members.

Further, when the seat 3 at the reference position (S) swings rearward, each of the rear follower 26*b* and the front follower 26*a* follows the upwardly inclined first regions

25*a*1 and 25*b*1, and upon further swinging, the rear follower 26*b* and the front follower 26*a* enter the second regions 25*a*2 and 25*b*2 configured with a larger inclination degree. Afterward, in the vicinity of the operation end, when the inclination degree is further increased to practically seldom reach the operation end, the shoe bless unit R is formed.

That is, in the present embodiment, an operation angle and an operation distance of the seat 3 freely operating forward, rearward, rightward, and leftward, in the front-rear direction are set so as to be larger than those in the left-right direction. More specifically, the operation angle of the seat 3 in the front-rear direction in a rear direction is set to be larger than that in a front direction.

Figure 7:
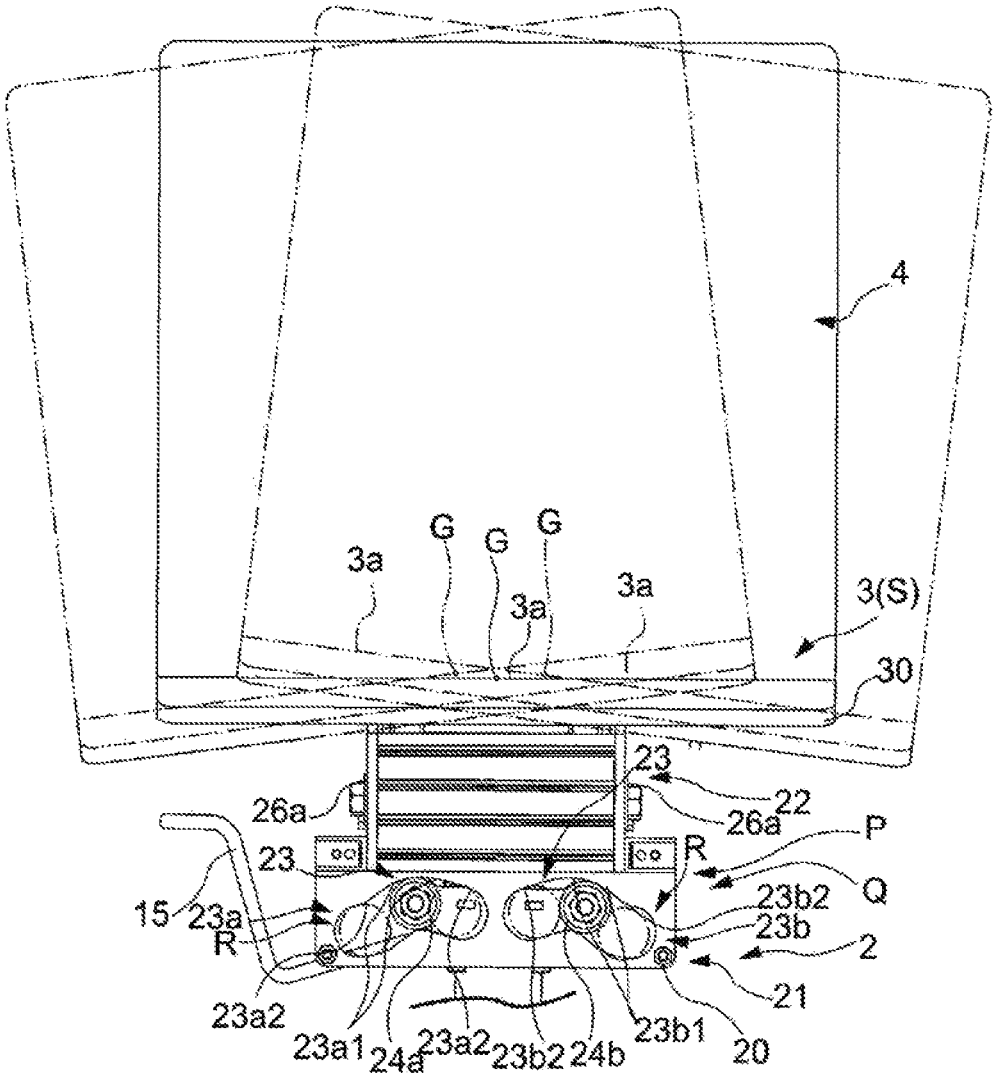
FIG. 7 is an operation explanatory diagram according thereto.
Figure 8:
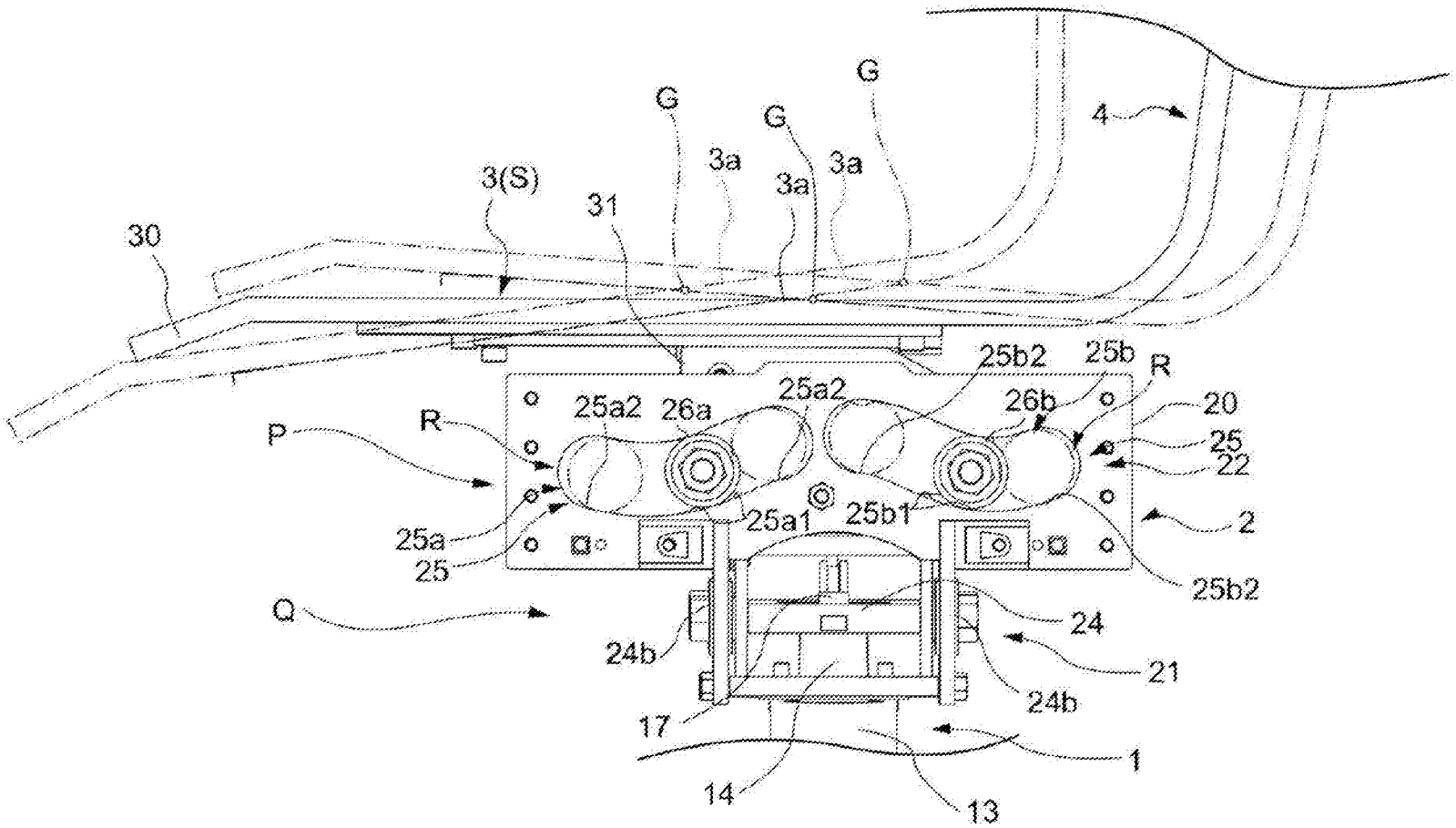
FIG. 8 is an operation explanatory diagram according thereto.

Here, in the present embodiment, in particular, as illustrated in FIG. 7 and FIG. 8, the movement of the seat surface 3*a* in the front, rear, right, and left direction, when the left follower 24*a*, the right follower 24*b*, the front follower 26*a*, and the rear follower 26*b* make a relative operation after following the left guide surface 23*a*, the right guide surface 23*b*, the front guide surface 25*a*, and the rear guide surface 25*b*, is configured to follow a previously set predetermined trajectory. In the present embodiment, the predetermined trajectory is formed along an operation range in which the seat 3 can incline at 8° forward, at 10° rearward, and at 3.4° in each of the left and right directions, with the reference position (S) as the center. Further, a movement dimension of the seat 3 based on the predetermined trajectory will be explained. If the seat 3 tilts forward at 8°, the seat 3 operates by 50 mm horizontally forward and by 4 mm upward. Further, if the seat 3 tilts rearward at 10°, the seat 3 operates by 50 mm horizontally rearward and by 6.5 mm upward. Further, at the operation end in the left-right direction, the seat 3 operates by 30 mm in the horizontal direction and b 1.8 mm upward from the reference position (S).

FIG. 7 illustrates a behavior of the seat 3 when the seat 3 operates in the left-right direction from a predetermined reference position (S) set on the guide surfaces 23*a* and 23*b*. As illustrated in FIG. 7, the position and the shape of the left guide surface 23*a* and the right guide surface 23*b* are adjusted so that if the seat surface 3*a* operates rightward and leftward by the left-right support unit 21, a position of the center of gravity G of the seat 3 between the left and right supporting points, that is, between the left and right followers 24*a* and 24*b*, slightly rises from a position of the center of gravity G, when the seat 3 is at the reference position (S) illustrated by solid lines. As a result, when operating rightward and leftward, a return force in a direction of returning the seat 3 to the reference position (S) is spontaneously generated. That is, in the present embodiment, the left guide surface 23*a* and the right guide surface 23*b* are a left-right return unit configured to generate a return force in the left-right direction, of the return-force generation mechanism, and function as the center-of-gravity movement mechanism P configured to elevate the center of gravity G of the seat 3 as the seat 3 operates from the reference position (S). Additionally, in the seat surface 3*a* operating rightward and leftward in FIG. 7, the position and the shape of the front guide surface 25*a* and the rear guide surface 25*b* are adjusted so that an amount of elevation at an operation base end side is greater than that at an operation tip side, and as a result, the operation tip side takes a descending posture. That is, in the present embodiment, the left guide surface 23*a* and the right guide surface 23*b* also function as the seat inclining mechanism Q.

FIG. 8 illustrates a behavior of the seat 3 operating in the front-rear direction from a predetermined reference position (S) set on the guide surfaces 25*a* and 25*b*. As illustrated in FIG. 8, the position and the shape of the front guide surface 25*a* and the rear guide surface 25*b* are adjusted so that if the seat surface 3*a* operates forward and rearward by the front-rear support unit 22, the position of the center of gravity G of the seat 3 between the front and rear supporting points, that is, between the front and rear followers 26*a* and 26*b*, slightly rises from a position of the center of gravity G, when the seat 3 is at the reference position (S) illustrated by solid lines. As a result, when operating forward and rearward, a return force in a direction of returning the seat 3 to the reference position (S), is spontaneously generated. That is, in the present embodiment, the front guide surface 25*a* and the rear guide surface 25*b* are a front-rear return unit configured to generate a return force in the front-rear direction, out of the return-force generation mechanism, and function as the center-of-gravity movement mechanism P configured to elevate the center of gravity G of the seat 3 as the seat 3 operates from the reference position (8). Additionally, in the seat surface 3*a* operating forward and rearward in FIG. 7, the position and the shape of the front guide surface 25*a* and the rear guide surface 25*b* are adjusted so that an amount of elevation at the operation base end side is greater than that at the operation tip side, and as a result, the operation tip side takes a descending posture. That is, in the present embodiment, the front guide surface 25*a* and the rear guide surface 25*b* also function as the seat inclining mechanism Q.

That is, in the present embodiment, by the left guide surface 23*a*, the right guide surface 23*b*, the front guide surface 25*a*, the rear guide surface 25*b*, and the left follower 24*a*, the right follower 24*b*, the front follower 26*a*, and the rear follower 26*b* that configure the support mechanism 2, the seat inclining mechanism Q and the center-of-gravity movement mechanism P being a return-force generation mechanism are configured.

Additionally, in the present embodiment, as described above, the first regions 23*a*1, 23*b*1, 25*a*1, and 25*b*1 and the second regions 23*a*2, 23*b*2, 25*a*2, and 25*b*2 are provided, in addition to the front-rear guide surfaces 23*a* and 23*b*, and the left-right guide surfaces 25*a* and 25*b*. As a result, during the operation of the seat 3 in the vicinity of the reference position (S), each of the followers 24*a*, 24*b*, 26*a*, and 26*b* is guided into the first regions 23*a*1, 23*b*1, 25*a*1, and 25*b*1 and thus, a backswing force to the reference position (S) is only exerted to an extent hardly felt by the seated person. On the other hand, in the vicinity of the operation ends in the front, rear, right, and left, each of the followers 24*a*, 24*b*. 26*a*, and 26*b* is guided into the second regions 23*a*2, 23*b*2, 25*a*2, and 25*b*2, and thus, the backswing force is exerted strongly. As a result, in the vicinity of the reference position (S), the seated person can experience a pleasant operation of the seat 3, and even in the vicinity of the operation end, the seat 3 is guided again to a pleasant operation in the vicinity of the reference position (S) due to the strong backswing to the reference position (S), whereby a feeling of safety can be obtained.

Figure 9:
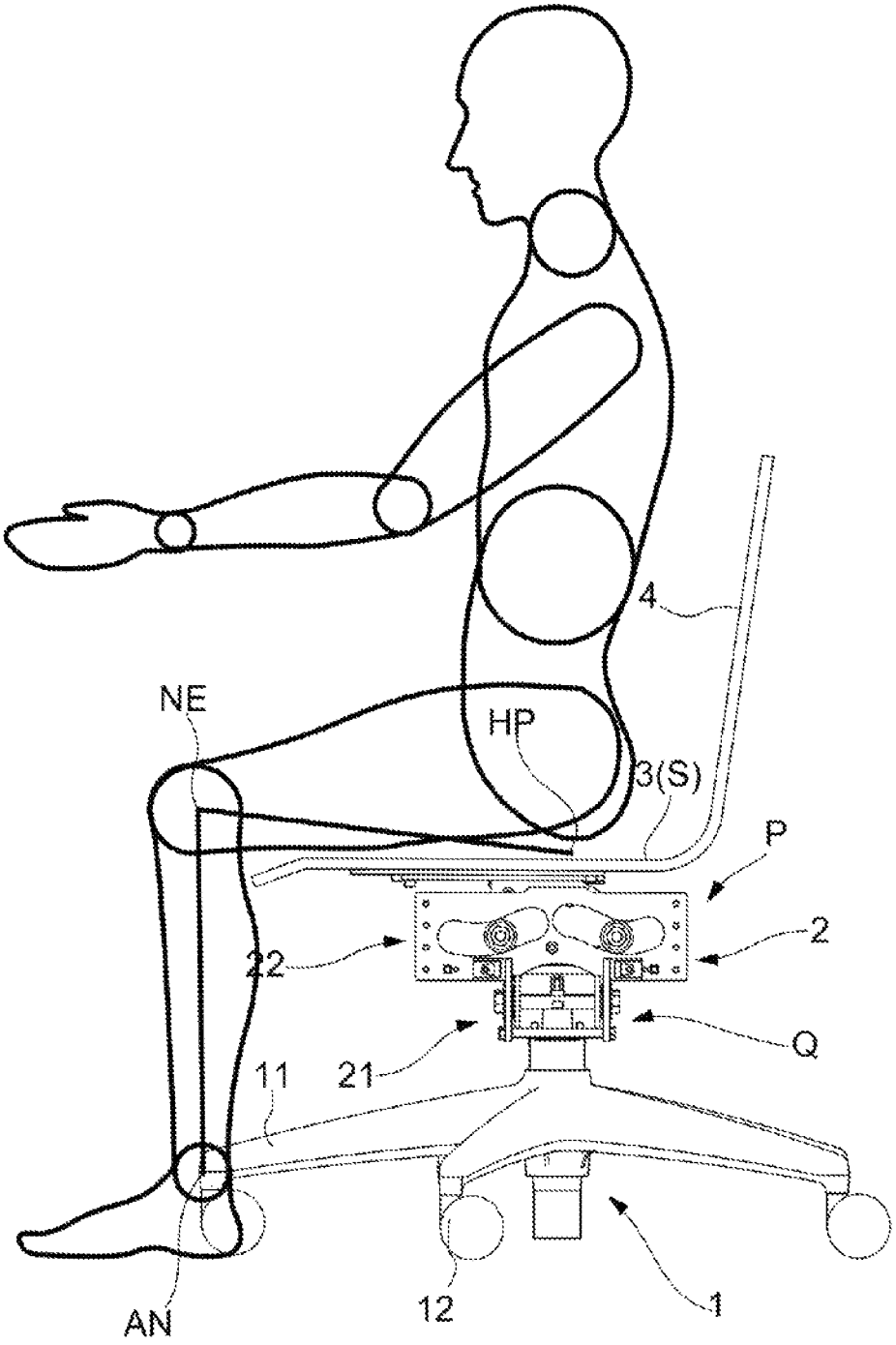
FIG. 9 is an explanatory diagram of an effect according thereto.
Figure 10:
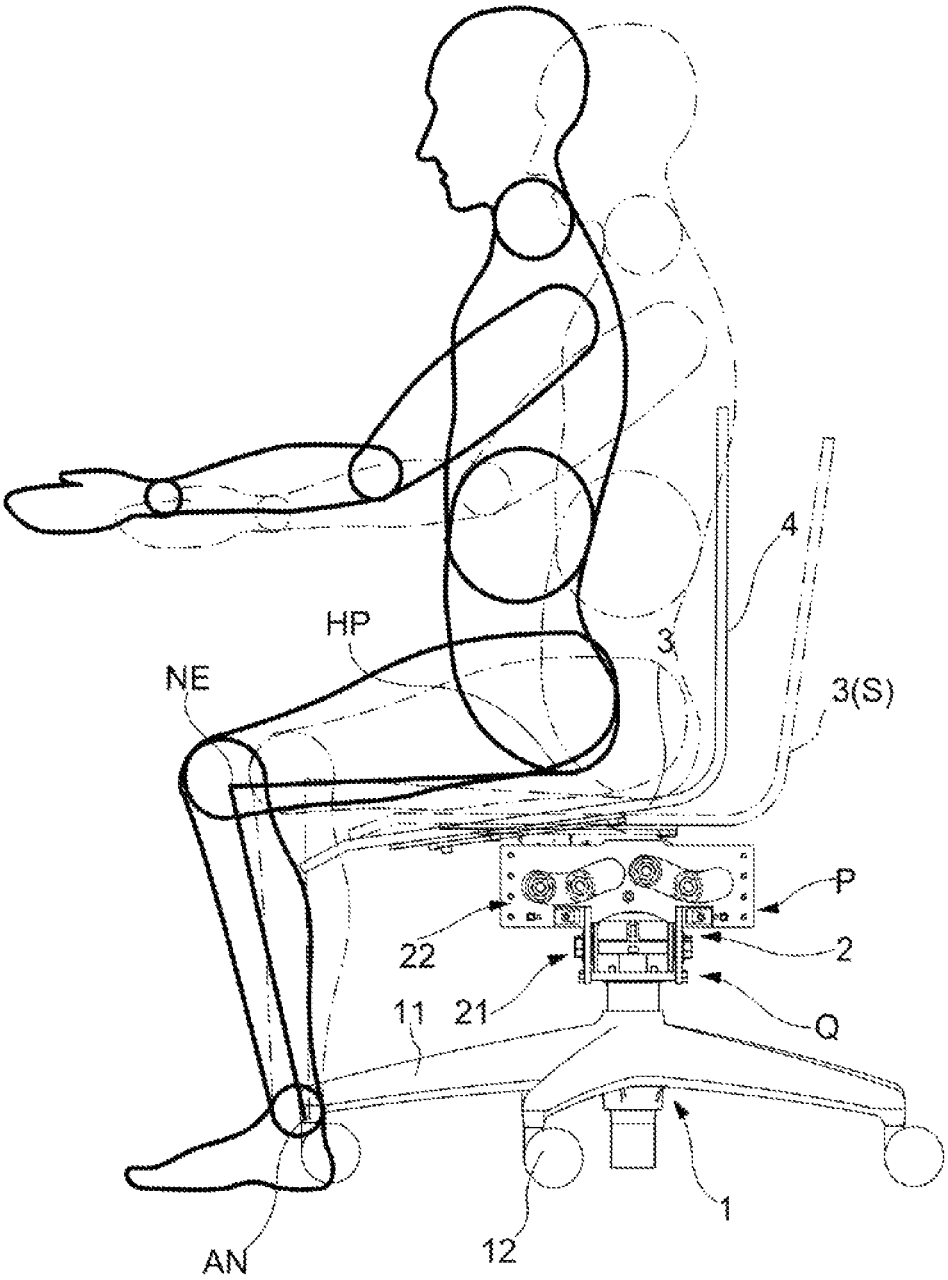
FIG. 10 is an explanatory diagram of an effect according thereto.

Subsequently, in FIG. 9 and FIG. 10, a behavior of the seated person, in particular, that of a lower body of the seated person, during the seat 3 inclining forward, will be described. Normally, if the seated person inclines the chair forward (or rearward) during sitting, as illustrated in FIG. 9 and FIG. 10, the seated person attempts to move by using an ankle (AN) as a main pivoting fulcrum, out of a knee (NE), the ankle (AN), and a vicinity of hip (HP). However, in a conventional chair, the pivoting fulcrum that operates the seat forward and rearward is spontaneously below the seat and in the vicinity of the seat 3, and thus, an operation allowing the seat to largely descend is performed together with the front-rear operation. Thus, actually, the vicinity of hip (HP) descends below the operation, and as a result, the seated person attempting to perform the operation described above unconsciously perceives a feeling where his/her knees (NE) are bent more than necessary.

Therefore, in the chair according to the present embodiment, when the center-of-gravity movement mechanism P acts during the seat 3 inclining forward, as illustrated in FIG. 9 and FIG. 10, an operation of the seat 3 is realized which resembles an operation of lifting the vicinity of hip (HP) along an operation with the ankle (AN) being the main pivoting fulcrum. In addition, the action of the seat inclining mechanism Q effectively avoids the front end portion of the seat 3 from undesirably interfering with the vicinity of the knee (NE) of the seated person.

Further, in the present embodiment, the operation of the seat 3 in the left-right direction may conform to the operation in FIG. 9 and FIG. 10. Therefore, while the seat 3 elevates the center of gravity G to conform to the operation of the knee (NE) and the vicinity of hip (HP) with the ankle (AN) of the seated person being the pivoting fulcrum and the seat 3 operates so that the operation tip is lower than the operation base end, and thus, a problem such as making the seated person uncomfortable in his/her knees (NE) or vicinity of hip (HP), or applying an undesirable load does not occur.

Thus, with the configuration described above, the chair according to the present embodiment follows the operation of the lumbar region and the gluteal region performed unconsciously by the seated person during sitting in order to maintain comfort, and in addition, the seated person performs an operation of returning to an initial posture by the return-force generation mechanism or performs another operation while maintaining the comfort. As a result, the chair according to the present embodiment provides comfort resulting from a natural operation for a human body. In other words, by considering the tendency of movement resulting from a body structure of the seated person during sitting, a chair which can suitably support the operation is achieved.

Specifically, in the chair according to the present, embodiment, the support mechanism 2 interposed between the leg 1 and the seat 3 is arranged below the seat 3, is configured to movably support the seat 3, at least at two locations in a front-rear direction and two locations in a left-right direction, along a predetermined trajectory, includes a seat inclining mechanism Q being a seat inclining function configured to downwardly incline the tip side in a movement direction of the seat 3 in accordance with movement of the seat 3, and further includes a return-force generation mechanism configured to generate, in accordance with an amount of movement a return force in a direction of returning the seat 3 having moved in the front-rear or left-right direction from the reference position (S), to the reference position (S).

With such a configuration, the chair according to the present embodiment not only suitably maintains the posture of the seated person during sitting, but can also suitably support the movement of the seated person during sitting. That is, even if the seated, person moves the center of gravity to the front, rear, right, and left, as long as the seat 3 has its center of gravity G located between the supporting locations arranged in the front and rear followers 26*a*, 28*b* at two locations in the front-rear direction, or as long as the seat 3 has its center of gravity G located between the left-right followers 24*a* and 24*b* or supporting locations arranged at two locations in the left-right direction, it is designed such that no large falling moment is exerted on the support mechanism 2, and thus, it is possible to reduce a need for the seated person to brace his/her feet to the floor to rest in a proper posture. Additionally, as it is possible to provide a trajectory appropriate for each of the front-rear direction and the left-right direction, and thus, even if the body movement of the seated person differs between the front and the rear, or even if the body movement of the seated person differs between the front-rear and the left-right, a support state properly corresponding to the body movement of the seated person is realized.

Further, it is not highly necessary for the seated person to brace his/her feet to the floor to assure balance, and thus, even if the lower end of the leg 1 is supported by the casters 12, a risk of the caster 12 running in an unexpected direction can be reduced, allowing for a stable use of the chair. In particular, the seat 3 supported by the above-described support mechanism 2 can be set not to perform a monotonous pivotal operation around a certain fulcrum close to the floor, and thus, the pivotal trajectory of the seat 3 can be accorded with or close to the operation below the knee of the seated person, as a result of which a proper support state is realized in which the feet do not get stuck even when inclining forward.

Further, with the support mechanism 2, there is no problem that the seat 3 sinks down every time the seated person sits down, and there is no inconvenience caused as in the case where the lower end of the supporting post comes in contact with the floor for pivoting. Thus, when the seat surface 3*a* inclines, the seat of the chair of the present invention moves in the direction of the inclination, and thus, the chair extraordinarily well can fit to the body movement of the seated person.

That is, according to the present invention, a chair is realized in which the seated person can perceive a comfortable sitting feeling even if sitting for a long time, and furthermore a high work efficiency can stably be maintained.

Additionally, in the present embodiment, the leg 1 includes a lifting up and down mechanism having the gas spring 14, the seat 3 is arranged above the lifting up and down mechanism, and the support mechanism 2 is interposed between the lifting up and down mechanism and the seat 3, and thus, a compact configuration is realized, instead of a complicated structure in which the support mechanism 2 is merged with the lifting up and down mechanism.

Further, in the present embodiment, the support mechanism 2 is configured to support the seat 3 independently and operatively in each of at least the front-rear direction and left-right direction along a predetermined trajectory, and thus, each of the forward, backward, rightward, and leftward operations of the seat 3 can be smoothly performed.

Additionally, in the present embodiment, the operation angle and the operation distance of the seat. 3 in the front-rear direction are set so as to be larger than those in the left-right direction, so that the operation of the seat 3 is properly adapted to the movement of the seated person, and the operation angle of the seat 3 in a rear direction is set to be larger than that in a front direction, so that the operation of the seat 3 is adapted more properly to the movement of the seated person.

Further, in the present embodiment, when the return-force generation mechanism is constructed as the center-of-gravity movement mechanism P configured to elevate the center of gravity G of the seat 3 in accordance with the operation of the seat 3 from the reference position (S), the return-force generation mechanism is realized with a simpler configuration. In particular, in the present embodiment, with a combination of the operations by the center-of-gravity movement mechanism P and the above-described seat inclining mechanism Q, it is less likely that even in an operation in which the seat surface 3*a* is inclined forward, the seated person does not easily take a posture in which the feet of the seated person get stuck, and thus, it is possible to further improve a comfort during sitting.

Further, in the present embodiment, a rotation support mechanism 16 configured to support the seat 3 horizontally rotatably is provided, and thus, the movement of the seated person during work may be more suitably followed.

Further, in the present embodiment, the support mechanism 2 includes the front-rear support unit 22 configured to operatively support the seat in the front-rear direction and the left-right support unit 21 configured to operatively support the seat in the left-right direction, where the left-right support unit 21 is configured separately from the front-rear support unit 22. The return-force generation mechanism includes a front-rear return unit configured to generate a return force in the front-rear direction and a left-right return unit configured to generate a return force in the left-right direction, where the left-right return unit is configured separately from the front-rear return unit. Thus, it is possible to maintain a comfortable sitting posture while individual components are simply configured.

In particular, in the present embodiment, the front-rear support unit 22 and the left-right support unit 21 are arranged to be layered at an overlapping position in planar view, and thus, a whole chair is compact in planar view.

Additionally, in the present embodiment, the backrest 4 is directly attached to the front-rear support unit 22, and thus, a back of the seated person is suitably supported and a more comfortable sitting feeling can be obtained.

Further, in the present embodiment, the support mechanism 2 includes the guide surfaces 23*a*, 23*b*, 25*a*, and 25*b* formed along a predetermined trajectory and the followers 24*a*, 24*b*, 28*a*, and 26*b* configured to perform a relative operation following the guide surfaces 23*a*, 23*b*, 25*a*, and 25*b*, and thus, a precise and stable operation of the seat 3 is realized.

Further, in the present embodiment, the support mechanism 2 has the slowing portion including the first regions 23*a*1, 23*b*1, 25*a*1, 25*b*1 and the second regions 23*a*2, 23*b*2, 25*a*2, and 25*b*2 configured to slow the operation of the followers 24*a*, 24*b*, 26*a*, and 26*b* toward the operation end of the followers 24*a*, 24*h*. 26*a*, and 26*b*, and thus, it is possible to effectively avoid a situation in which the seated person is given an undesirable "fear" or discomfort due to an unintended abrupt operation of the seat 3.

In addition, in the present embodiment, the support mechanism includes the shockless unit R configured to avoid a collision between the end of the guide surfaces 23*a*, 23*b*, 25*a*, and 25*b* and the followers 24*a*, 24*b*, 26*b*, and 26*b* at the operation end, and thus, an undesirable shock and noise due to the abrupt operation of the seat 3 is not inflicted on the seated person.

In addition, in the present embodiment, the leg 1 includes the casters 12, and thus, it is possible to prevent the chair from easily moving even if the seat 3 operates forward, rearward, rightward, or leftward while the seated person can move together with the chair while being seated when required. This eliminates an element for gripping the floor surface by frictional force to swing the seat 3 during sitting, unlike in Japanese Unexamined Patent Application Publication (Translation of PCT Application) No. 10-513374.

Particularly, in the present embodiment, in order to realize the above-described behavior of the chair 3 with the support mechanism 2 alone, the support mechanism 2 is configured to move the supporting locations to the seat 3 to the front, rear, right, and left by combining the front support structure including the front guide surface 25*a* and the front follower 28*a* and the rear support structure including the rear guide surface 25*b* and the rear follower 26*b*, configured to directly or indirectly support the bottom surface of the seat 3 at least at two locations in the front-rear direction, and the left support structure including the left guide surface 23*a* and the left follower 24*a* and the right support structure including the right guide surface 23*b* and the right follower 24*b*, configured to directly or indirectly support the bottom surface of the seat 3 at two locations in the left-right direction, the supporting locations being configured to draw a trajectory along which the tip side in a movement direction of the seat 3 is downwardly inclined in accordance with the movement, and the support mechanism 2 further includes a return-force generation mechanism configured to generate, in accordance with the amount of movement, the return force in the direction of returning the supporting locations to the seat 3 having moved from the reference position (S) in the front-rear or left-right direction, to the reference position (S).

As a specific mode of an implementation, in the present embodiment, a configuration so that, as the front-rear supporting locations supported by the front-rear support unit 22 are moved in the front direction from the reference position (S), the front-side supporting location is relatively lower than the rear-side supporting location, and as the front-rear supporting locations are moved in the rear direction from the reference position (S), the rear-side supporting location of the seat 3 is relatively lower than the front-side supporting location, is applied. Alternatively, a configuration so that as the left-right supporting locations supported by the left-right support unit 21 are moved in the left direction from the reference position (S), the left-side supporting location is relatively lower than the light-side supporting location, and as the left-right supporting locations are moved in the right direction from the reference position (s), the right-side supporting location of the seat 3 is relatively lower than the left-side supporting location, is applied. Here, the "supporting locations" are naturally contact points or contact portions between the front, rear, right, and left guide holes 23*a*, 23*b*, 25*a*, and 25*b* and the front, rear, right, and left followers 24*a*, 24*b*, 26*a*, and 26*b*. Further, in a process of the operation of the seat, the contact points or contact portions may change vertically. Particularly, if the center of gravity of the seated person is not between the supporting locations, the contact points or the contact portions may change vertically.

A modification of the present invention, as well as other embodiments, will be described below. In the following modifications and embodiments, elements corresponding to constituent elements of the embodiment described above will be referred to by the same reference numerals and detailed description thereof will be omitted.

Modification

Figure 11:
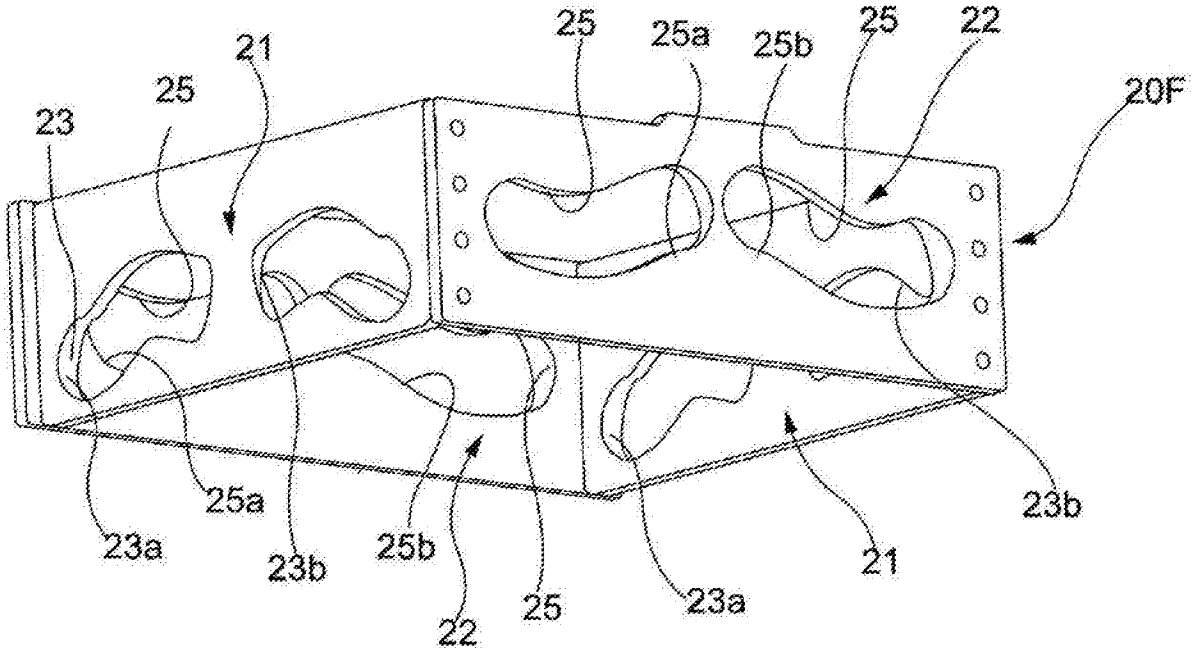
FIG. 11 is an explanatory diagram according to a modification of the first embodiment.

In FIG. 11, a support housing 20F is illustrated instead of the support housing 20 disclosed in the above-described embodiment. That is, in the above-described embodiment, in order that the left-right support unit 21 and the front-rear support unit 22 are positioned by the support housing 20 at an overlapping position in planar view, each portion configuring the front-rear support unit 22 and the left-right support unit 21 is configured to be layered in an up-down direction; however, the support housing 20F is configured so that the front-rear support unit 22 and the left-right support unit 21 overlap in the up-down direction. Needless to say, in the modification, a configuration of a portion in the vicinity of the upper end of the leg 1 of the chair and a portion in the vicinity of the seat receiver 31 may be accordingly changed in accordance with a shape of the support housing 20F.

With the configuration, when a pair of left-right support units 21 in the front-rear direction and a pair of front-rear support units 22 in the right-left direction are configured at the same height position, a chair compact in the up-down direction can be provided while realizing an operation similar to that the above-described first embodiment.

Figure 12:
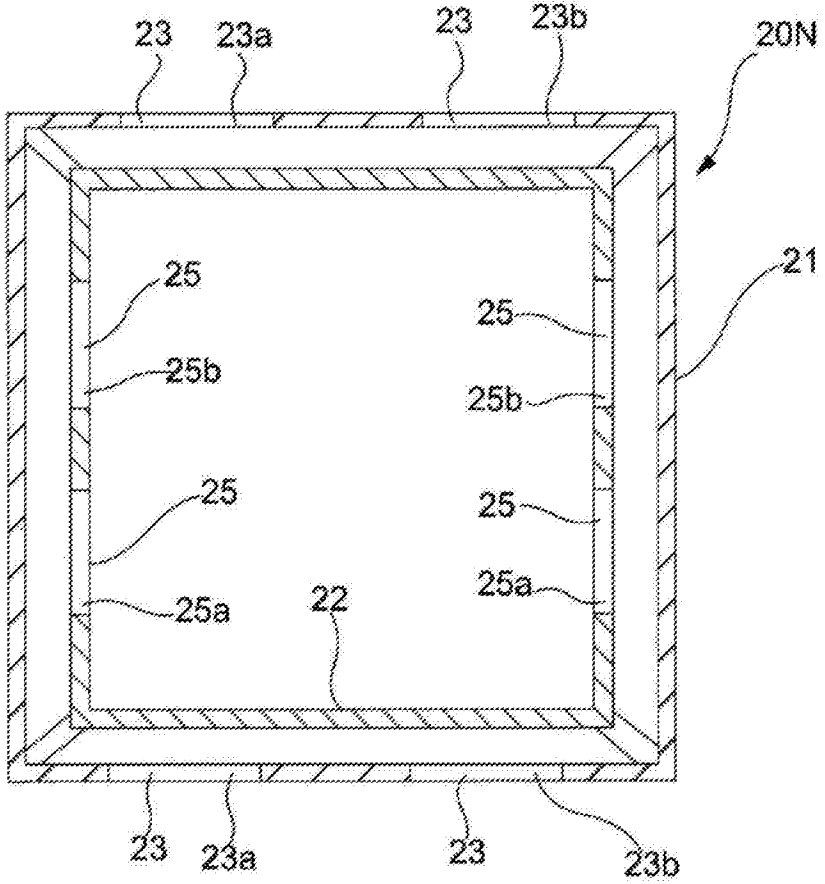
FIG. 12 is a schematic plane cross-sectional view according to another modification thereof.

Further, FIG. 12 illustrates a schematic plane cross-section of a support housing 20N used instead of the support housing 20 disclosed in the above-described embodiment. That is, in the above-described embodiment, in order that the left-right support unit 21 and the front-rear support unit 22 are positioned by the support housing 20 at an overlapping position in planar view, each portion configuring the front-rear support unit 22 and the left-right support unit 121 is configured to be layered in the up-down direction; however, the support housing 20N is configured so that the front-rear support unit 22 and the left-right support unit 21 are nested (the front-rear support unit 22 being inside and the left-right support unit 21 being outside respectively) to overlap in both planar view and front view (not illustrated). Needless to say, in the modification, a configuration of a portion in the vicinity of the upper end of the leg 1 of the chair and a portion in the vicinity of the seat receiver 31 may be accordingly changed in accordance with a shape of the support housing 20N.

In this configuration, similarly to above, when a pair of left-right support units 21 in the front-rear direction and a pair of front-rear support units 22 in the right-left direction are configured at the same height position, a chair compact in the up-down direction can be provided while realizing an operation similar to that in the above-described first embodiment.

Figure 13A:
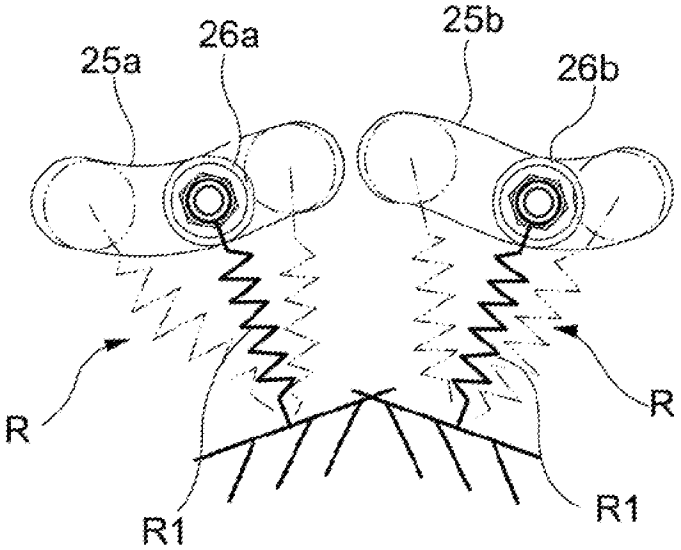
FIGS. 13A and 13B are explanatory diagrams according to the other modification thereof.
Figure 13B:
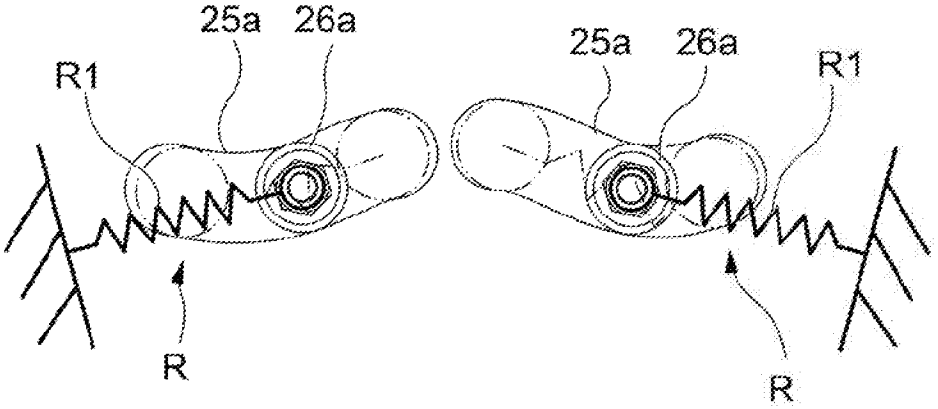
Figure 14:
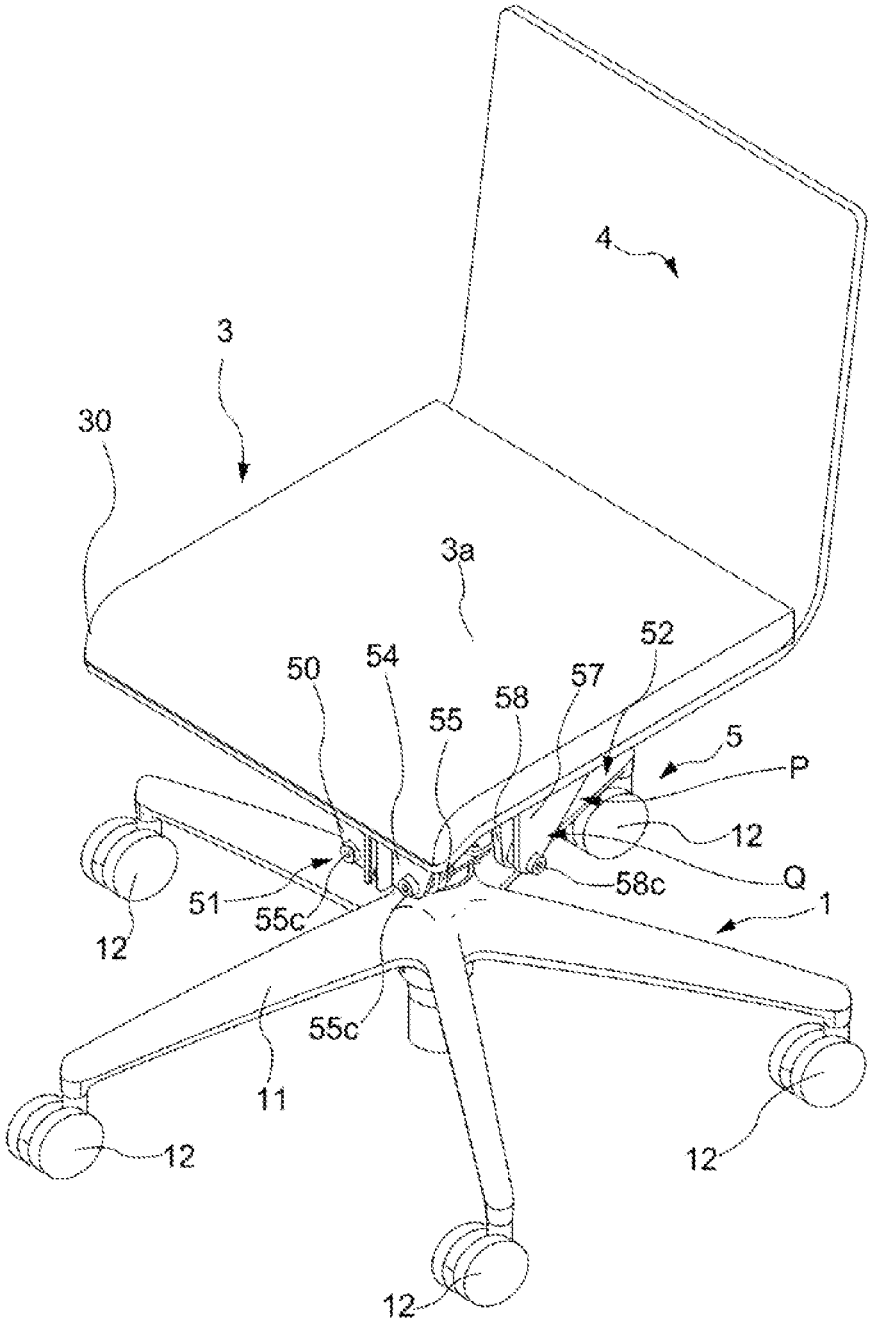
FIG. 14 is an appearance diagram according to a second embodiment of the present invention.
Figure 15:
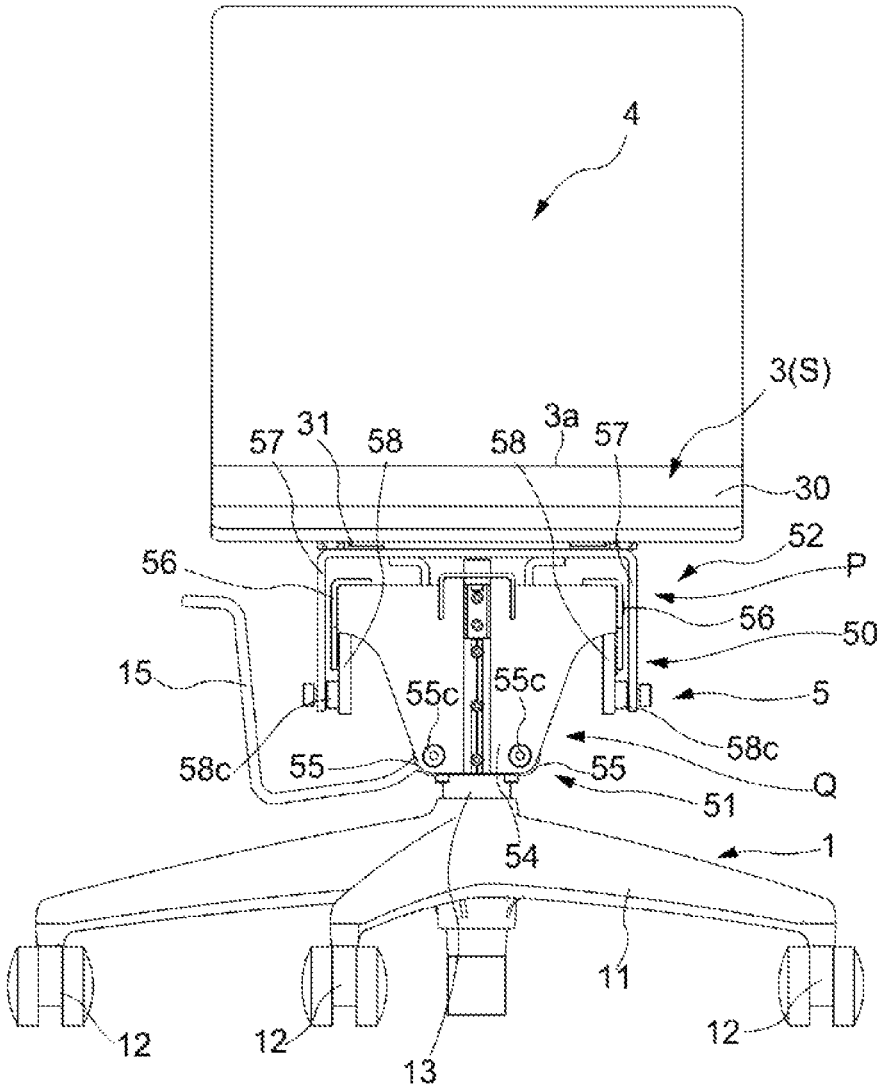
FIG. 15 is a front view according thereto.
Figure 16:
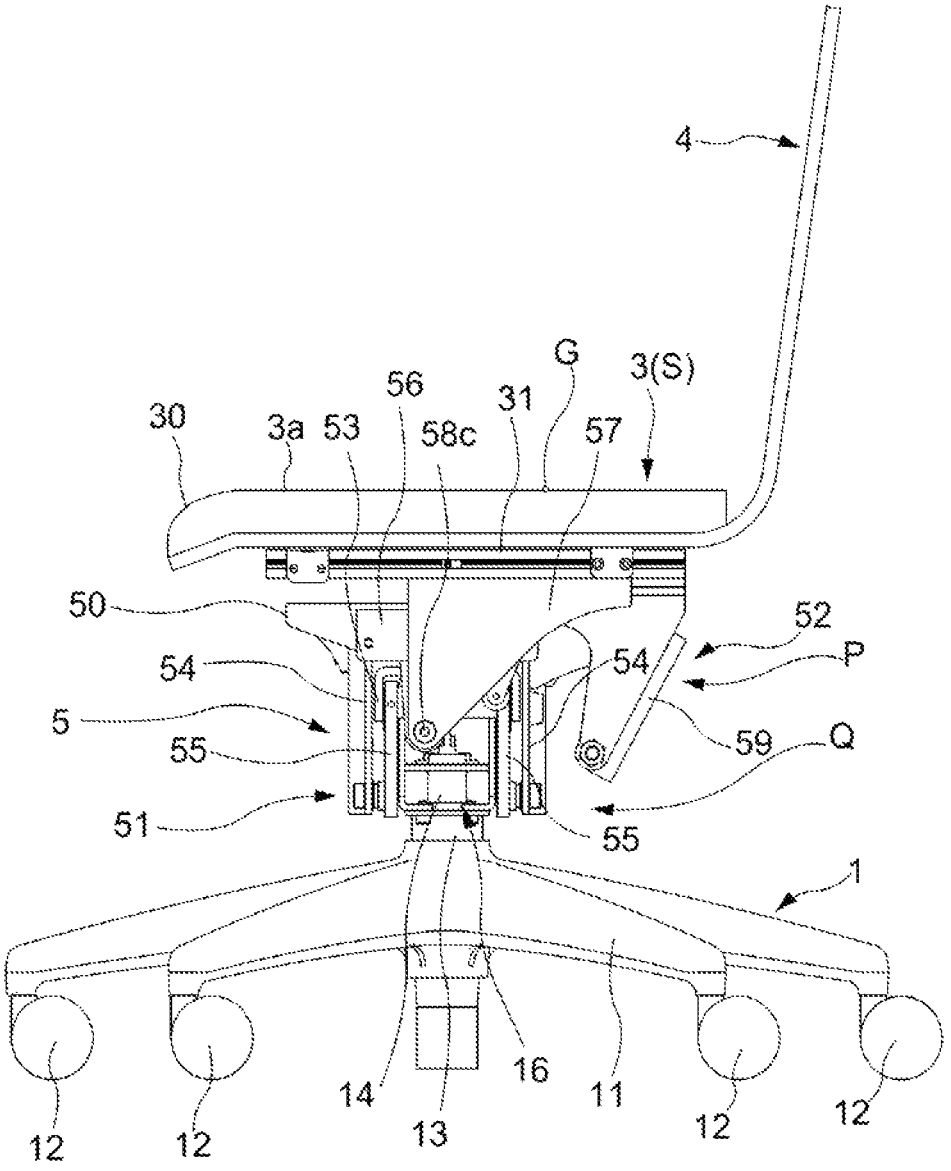
FIG. 16 is a side view according thereto.
Figure 17:
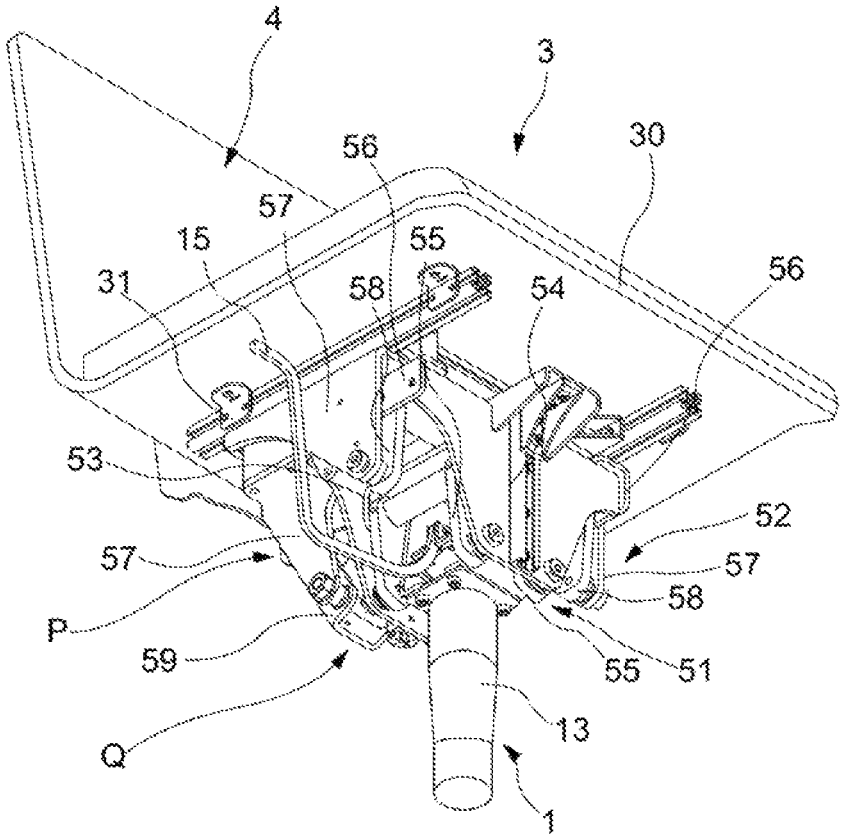
FIG. 17 is a perspective view of main parts according thereto.
Figure 18:
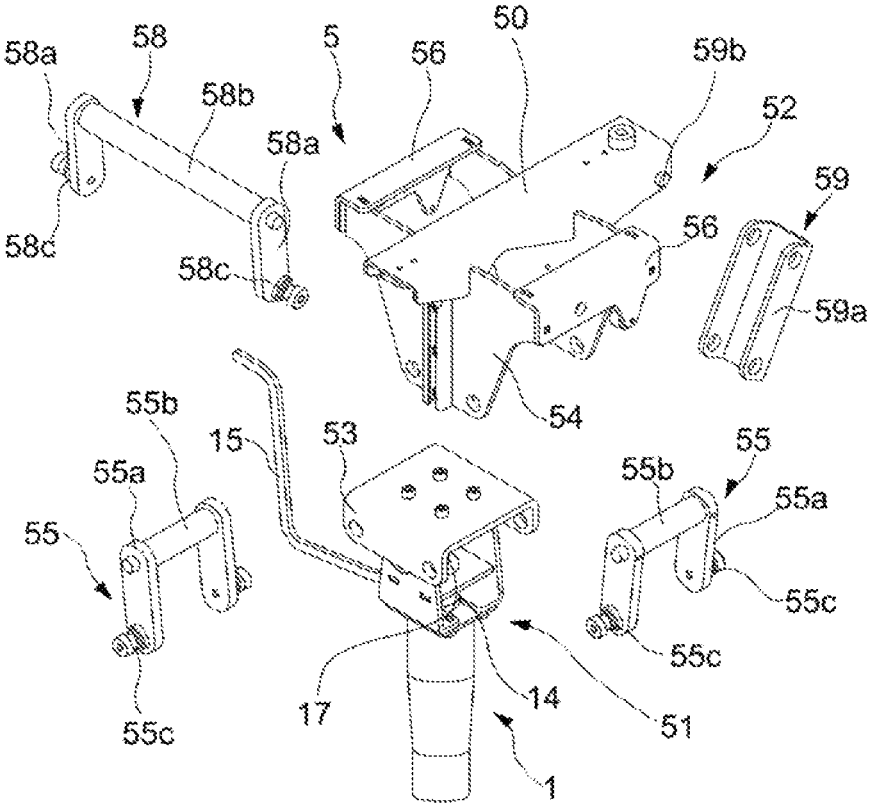
FIG. 18 is an exploded perspective view thereof.
Figure 19:
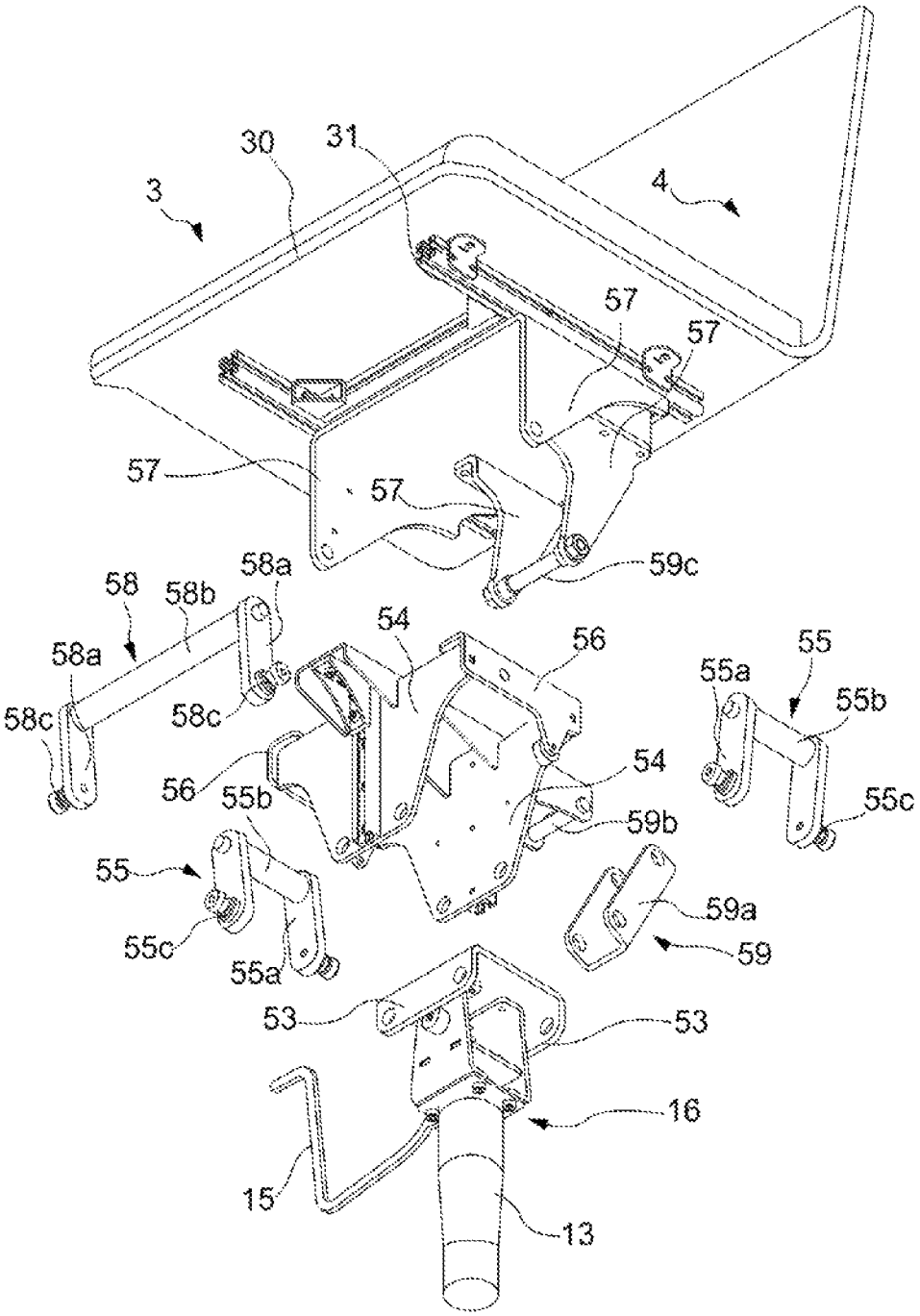
FIG. 19 is an exploded perspective view thereof.

Further, another modification of the above-described shockless unit R is illustrated in FIG. 13A and FIG. 13B. That is, FIG. 13A and FIG. 13B illustrate a mode in which when an elastic means R1 such as a tensile coil spring arranged in a fixed portion of the chair is connected to the front and rear followers 26*a*, 26*h* so that the seat 3 biases toward the reference position (S), the shockless unit R as described above is configured. Further, in FIG. 13A and FIG. 13B, the biasing directions of the elastic means R1 differ; however, these are similar in that in the both cases, the front and rear followers 26*a*, 26*b* are biased so that the seat 3 reaches the reference position (S).

Second Embodiment

A chair according a second embodiment of the present invention may be suitably utilized as an office rotating chair, similarly to that in the first embodiment described above.

That is, also in the chair according to the present embodiment, a support mechanism 5 interposed between the leg 1 and the seat 3 is arranged below the seat 3, is configured to movably support the seat 3, at least at two locations in the front-rear direction and two locations in the left-right direction, along a predetermined trajectory, includes a seat inclining mechanism Q being a seat inclining function configured to downwardly incline the tip side in a movement direction of the seat 3 in accordance with movement of the seat 3, and further includes a return-force generation mechanism configured to generate the return force in the direction of returning the seat 3 having moved from the reference position (S) in the front-rear or left-right direction, to the reference position (S).

Other than the feature that a cushion is provided on the seat main body 30, the feature that the chair is comprised mainly of the leg 1 coming in contact with the floor surface, the seat 3 provided above the leg 1, and the backrest 4 integrally formed into the seat 3 is similar in configuration to the above-described embodiment, and thus, the description therefor will be omitted. The chair according to the present embodiment is similar to that in the above-described embodiment in that the support mechanism is configured across the upper end portion of the leg 1 to the lower end portion of the seat receiver 31.

However, in the chair according to the present embodiment, the support mechanism 5 is configured as a suspension support mechanism different from that in the above-described embodiment, and consequently, the return force generating mechanism and the seat inclining mechanism Q are configured in a different mode.

Here, the chair according to the present invention is provided with the support mechanism 5 as the suspension support mechanism configured to operatively support the seat 3, at least in the front-rear direction and in the right-left direction, along a predetermined trajectory by suspending a part of the seat 3 from a part of the leg 1 from above.

The configuration of the chair according to the present embodiment will be described with a focus on the configuration of the support mechanism 5 being a suspension support mechanism, below.

As illustrated in FIG. 14 to FIG. 19, the support mechanism 5 is interposed between the leg 1 and the seat 3, and applies a link mechanism having link members 55, 58, and 59 extending in the up-down direction so that the seat 3 can be operatively supported along a predetermined trajectory along which the seat 3 is operated in the front-rear direction and in the right-left direction. The support mechanism 5 is configured by the upper end portion of the leg 1, the lower end portion of the seat receiver 31, and a swing support body 50 interposed between the upper end portion of the leg 1 and the lower end portion of the seat receiver 31. The support mechanism 5 includes a left-right support unit 51 configured to operatively support the seat 3 in the right-left direction over the upper end portion of the leg 1 and the lower region of the swing support body 50, and a front-rear support unit 52 configured to operatively support the seat 3 in the front-rear direction over the lower end portion of the seat receiver 31 and the upper region of the swing support body 50. That is, the left-right support unit 51 and the front-rear support unit 52 overlap in the up-down direction at an overlapping position in planar view and are independently configured as a separate body at a position surrounding the leg supporting post 13 as the center in the plan view of the seat 3. In addition, in the present embodiment, the front-rear support unit 52 directly supports the seat 3 integrally configured with the backrest 4, and thus, in the present embodiment, configuration is that the backrest 4 is indirectly attached to the front-rear support unit 52; however, needless to say, configuration that the backrest 4 is attached on the upper half region of the swing support body 50 shall not be precluded.

The left-right support unit 51 includes a left-right swing unit 54 formed in a lower half region of the swing support body 50, a left-right suspension unit 53 configured to suspend and support the left-right swing unit 54 formed on the upper end of the leg 1, and a pair of left-right links 55 pivotally attached to the left-right swing unit 54 and the left-right suspension unit 53. The left-right link 55 includes a link main body 55*a* extending in the up-down direction, a suspension shaft 55*b* configured at the upper end of the link main body 55*a* to be pivotally attached onto the left-right suspension unit 53, and a swing shaft 55*c* configured at a lower end of the link main body 55*a* to be pivotally attached onto the left-right swing unit 54. Further, the pair of left-right links 55 is set so that a distance between the swing shafts 55*c* provided at the lower end of the left-right link 55 is shorter than a distance between the suspension shafts 55*b* provided at the upper end of the left-right link 55. Further, in the present embodiment, the right support structure and the left support structure are configured by the supporting location of the left-right link 55 and the left-right link 55.

The front-rear support unit 52 includes a front-rear swing unit 57 formed at a lower end of the seat receiver 31, a front-rear suspension unit 56 formed in an upper half region of the swing support body 50, the front-rear suspension unit 56 being for suspending and supporting the front-rear swing unit 57, and a front link 58 and a rear link 59 pivotally attached onto the front-rear swing unit 57 and the front-rear suspension unit 56. The front link 58 includes a front link main body 58*a* extending in the up-down direction, a front suspension shaft 58*b* configured at an upper end of the front link main body 58*a*, the front suspension shaft 58*b* being pivotally attached at a front side position of the front-rear suspension unit 56, and a front, swing shaft 58*c* configured at a lower end of the front link main body 58*a*, the front swing shaft 58*c* being pivotally attached at a front side position of the front-rear swing unit 57. The rear link 59 includes a rear link main body 59*a* extending in the up-down direction, a rear suspension shaft 59*b* configured at an upper end of the rear link main body 59*a*, the rear suspension shaft 59*b* being pivotally attached to the front-rear suspension unit 56, and a rear swing shaft 59*c* configured at a lower end of the rear link main body 59*a*, the rear swing shaft 59*c* being pivotally attached to the front-rear swing unit 57. Further, the front link 58 and the rear link 59 are set so that a distance between the front swing shaft 58*c* and the rear swing shaft 59*c* provided at the lower end of the front link 58 and the rear link 59 is shorter than a distance between the front suspension shaft 58*b* and the rear suspension shaft 59*b* provided at the upper end of the front link 58 and the rear link 59. Further, in the present embodiment, the front support structure is configured by the front link 58 and the location at which the front link 58 is supported, and the rear support structure is configured by the rear link 59 and the location at which the rear link 59 is supported.

Figure 20:
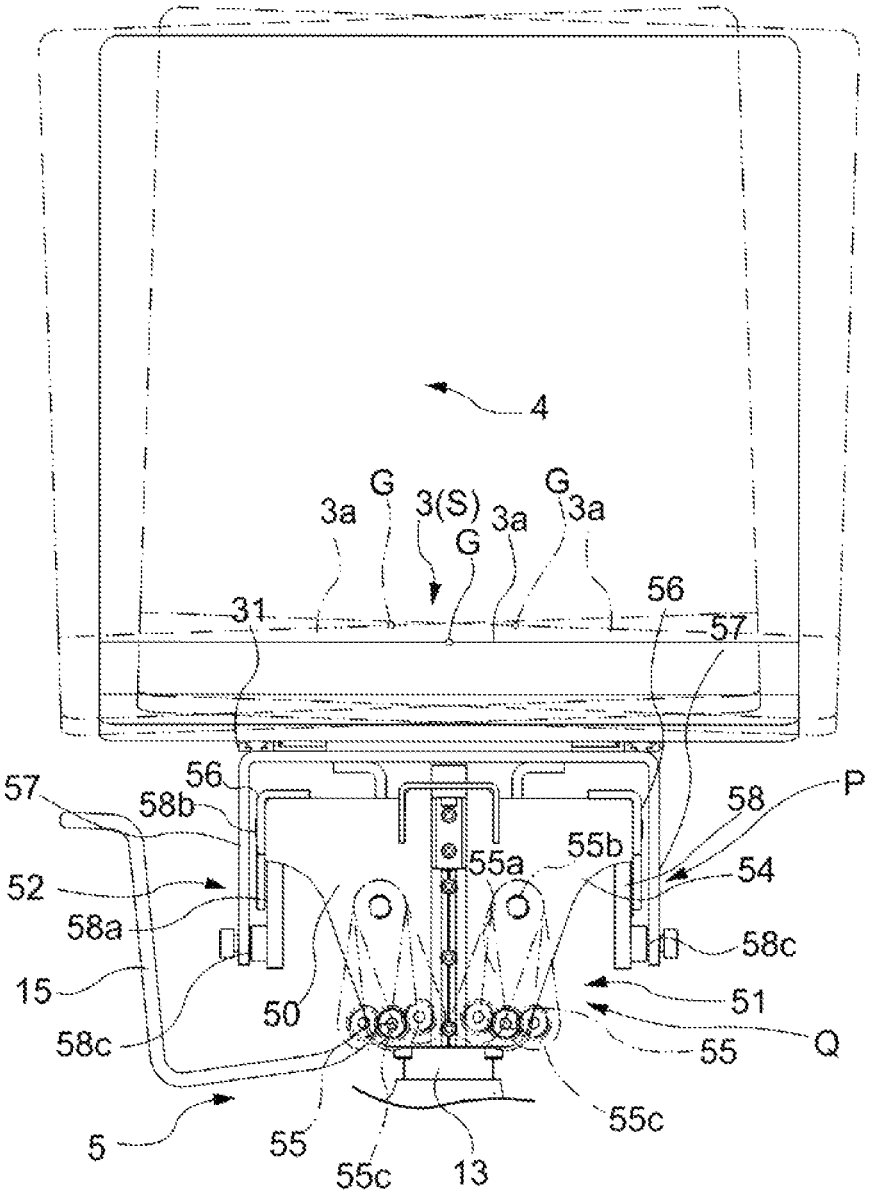
FIG. 20 is an operation explanatory diagram according thereto.
Figure 21:
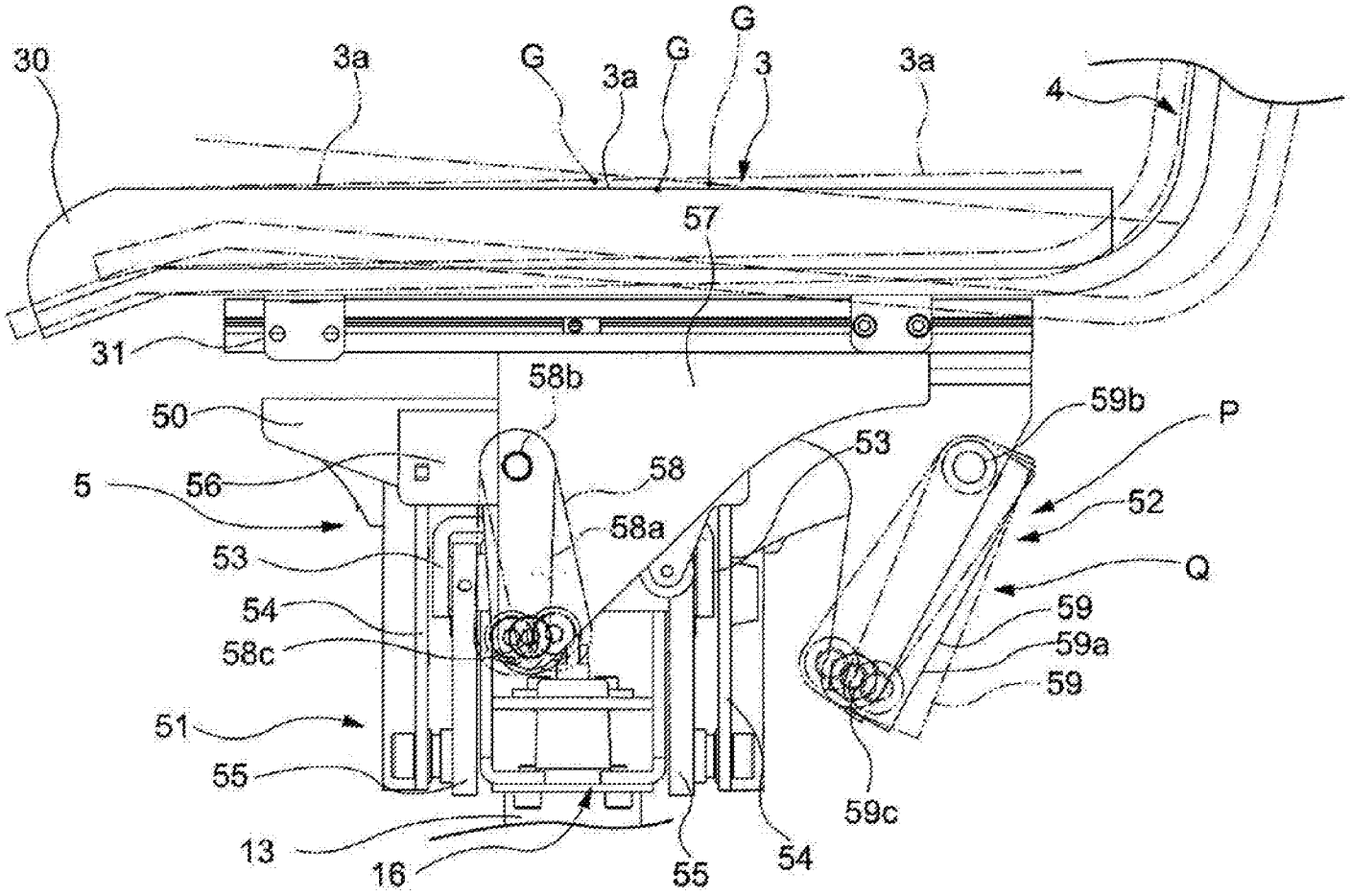
FIG. 21 is an operation explanatory diagram according thereto.

Here, in the present embodiment, particularly as illustrated in FIG. 20 and FIG. 21, it is so configured that the movement of the seat surface 3*a* swinging in the front-rear and right-left directions by the effect of the left-right support unit 51 and the front-rear support unit 52 runs along a previously set predetermined trajectory.

FIG. 20 illustrates a behavior when the seat 3 operates in the right-left direction from the predetermined reference position (S) at which the seat 3 rests by its own weight. As illustrated in FIG. 20, when the seat surface 3*a* operates rightward and leftward by the left-right support unit 51, its operation is against the gravity. Specifically, when any or both of the swing shafts 55*c* provided at the lower end of the left-right link 55 are elevated, the position of the center of gravity G of the seat surface 3*a* rises from the reference position (S) indicated by a solid line. Further, at this time, a return force exerted by the gravity in a direction of returning the seat 3 to the reference position (S) is spontaneously applied to the seat 3. That is, in the present embodiment, the left-right link 55 is the left-right return unit, out of the return-force generation mechanism, configured to generate the return force in the right-left direction, and functions as the center-of-gravity movement mechanism P configured to elevate the center of gravity G of the seat 3 when the seat 3 operates from the reference position (S). In addition, the seat surface 3*a* operating rightward and leftward in FIG. 20 is in a posture in which the operation tip side is descended. As mentioned above, this results from the feature that the distance between the swing shafts 55*c* provided at the lower end of the left-right link 55 is set to be shorter than the distance between the suspension shafts 55*b* provided at the upper end of the left-right link 55. That is, in the present embodiment, the left-right link 55 also functions as the seat inclining mechanism Q.

FIG. 21 illustrates a behavior when the seat 3 operates in the front-rear direction from the predetermined reference position (S) at which the seat 3 rests by its own weight. As illustrated in FIG. 21, when the seat surface 3*a* operates forward and rearward by the front-rear support unit 52, its operation is against the gravity. Specifically, when any or both of the front swing shaft 58*c* and the rear swing shaft 59*c* provided at the lower end of the front link 58 and the rear link 59 are elevated, the position of the center of gravity G of the seat surface 3*a* elevates from the reference position (S) indicated by the solid line. Further, at this time, a return force exerted by the gravity in a direction of returning the seat 3 to the reference position (S) is spontaneously applied to the seat 3. That is, in the present embodiment, the front link 58 and the rear link 59 correspond to the front-rear return unit, out of the return-force generation mechanism, configured to generate the return force in the front-rear direction, and functions as the center-of-gravity movement mechanism P configured to elevate the center of gravity G of the seat 3 in accordance with the operation of the seat 3 from the reference position (S). In addition, in FIG. 21, the seat surface 3*a* operating forward and rearward takes a posture in which the operation tip side is descended. As described above, this results from the feature that the distance between the front swing shafts 58*c* and the rear swing shaft 59*c* provided at the lower end of the front link 58 and the rear link 59 is set to be shorter than the distance between the front suspension shaft 58*b* and the rear suspension shaft 59*b* provided at the upper end of the front link 58 and the rear link 59. That is, in the present embodiment, the front link 58 and the rear link 59 also function as the seat inclining mechanism Q.

That is, in the present, embodiment, the seat inclining mechanism Q and the center-of-gravity movement mechanism P being a return-force generation mechanism are configured by the pair of left-right links 55, the front link 58, and the rear link 59 included in the support mechanism 5.

Modification

Figure 22:
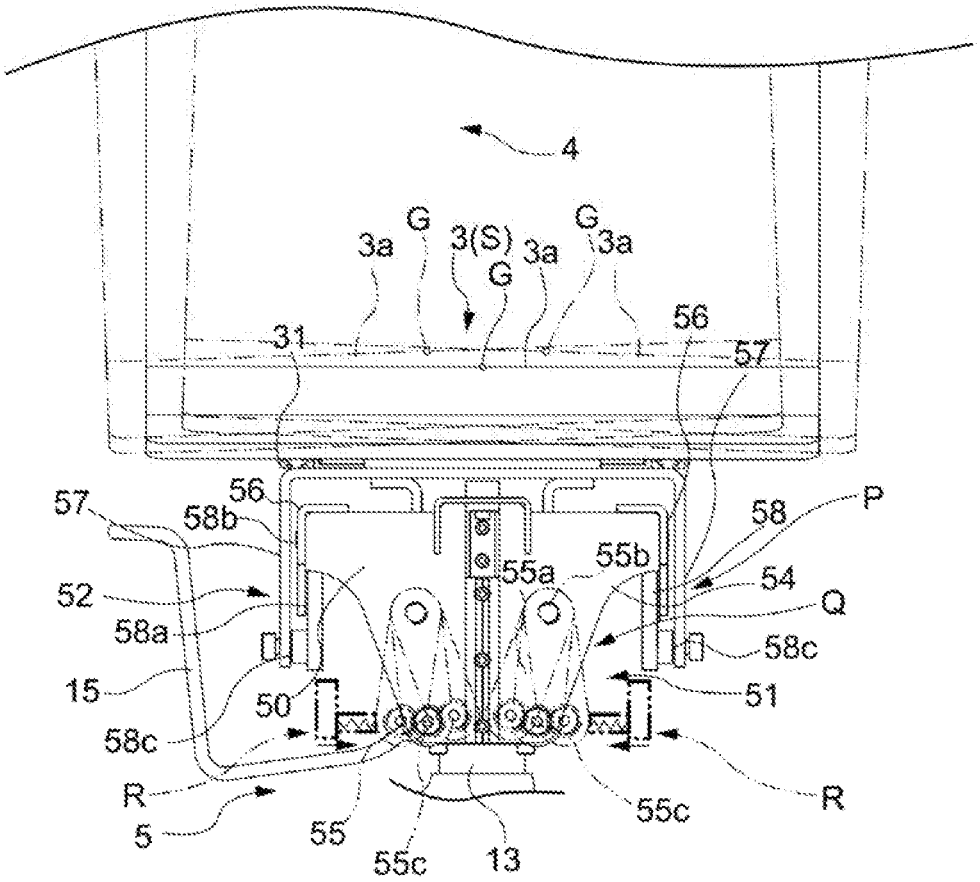
FIG. 22 is an operation explanatory diagram according to a modification of the second embodiment.
Figure 23:
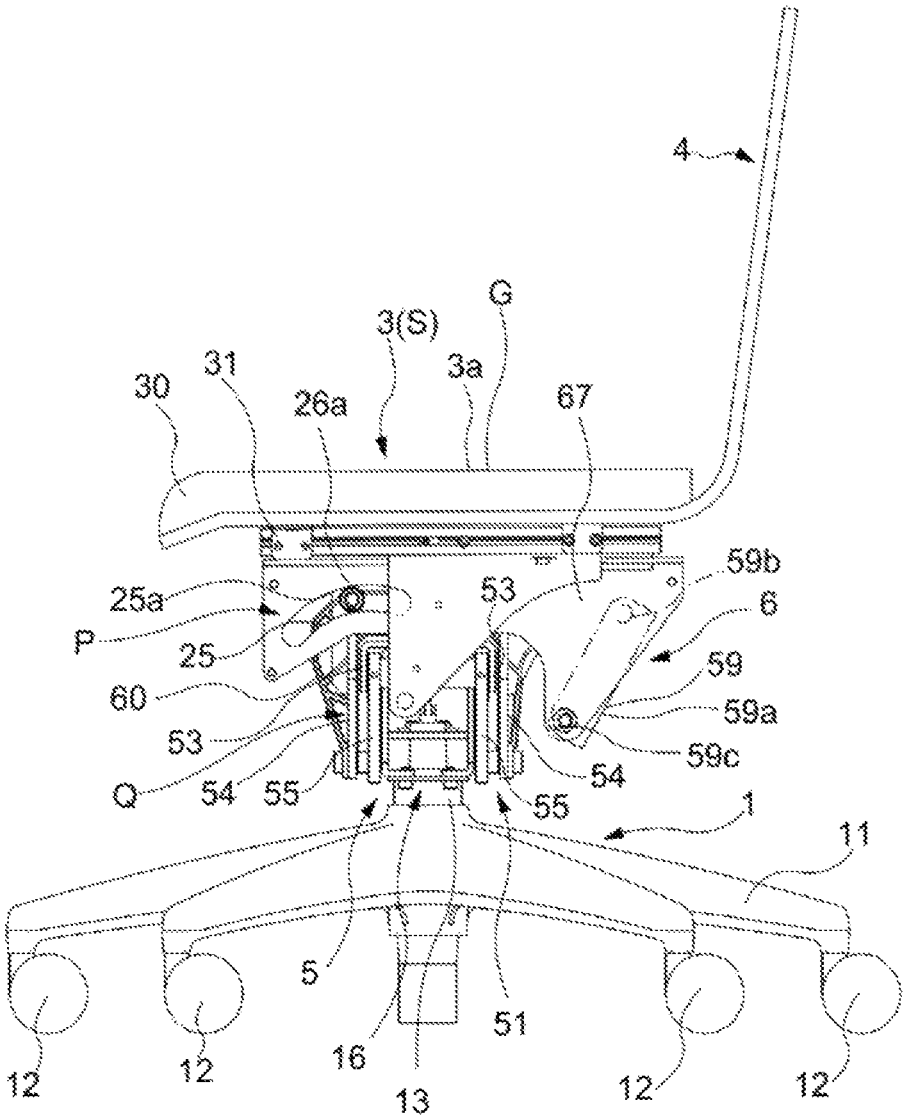
FIG. 23 is a side view according_ to a third embodiment of the present invention.

FIG. 22 illustrates an example in which the shockless unit R disclosed in the first embodiment is applied to the second embodiment. That is, in the shockless unit R, an elastic means abuts against the left-right link 55 in the vicinity of the operation terminal end of the left-right link 55 so that a collision between the constituent elements can be avoided. Needless to say, the position at which the elastic means is provided is not limited to the outside of the left-right link 55. The elastic member may be provided inside the left-right link 55 and may be configured to come into contact with other constituent elements operating along with the seat.

Further, although not illustrated, when attempting to provide the slowing portion and the shockless unit R disclosed in the embodiments described above by a mode different from the above-described mode, components such as a rotary damper may be separately installed in the link members 55, 58, and 59. That is, when a component such as a rotary damper is installed, it is possible to effectively avoid slowing down of the operation toward the operation end of each of the link members 55, 58, and 59 and a collision with other constituent elements of the chair at the operation end.

Thus, in the chair according to the present embodiment, an effect similar to the first embodiment described above can be realized. In addition, in the present embodiment, a smoother operation in accordance with the movement of the seated person is realized by configuring the support mechanism 5 as the suspension support mechanism having the link members 55, 58, and 59 allowing the operation ends to be operable along a predetermined trajectory.

In addition, in the present embodiment, the leg 1 includes a lifting up and down mechanism having the gas spring 14, the seat 3 is provided above the lifting up and down mechanism, and the support mechanism 5 is interposed between the lifting up and down mechanism and the seat 3, and thus, a compact configuration is realized, instead of a complicated structure in which the support mechanism 5 is merged with the lifting up and down mechanism.

Further, in the present embodiment, by configuring the support mechanism 5 as the suspension support mechanism having the link members 55, 58, and 59, the seat is supported operatively and independently at least in the front-rear direction and right-left direction along a predetermined trajectory, and thus, each of the forward, backward, rightward, and leftward operations of the seat 3 can be more smoothly performed.

Further, in the present embodiment, the front-rear support unit 52 and the left-right support unit 51 are provided to overlap in the up-down direction at an overlapping position in planar view and thus, at the same time, a more compact configuration of the support mechanism 5 is realized.

In particular, in the present embodiment, to realize the behavior of the above-described seat 3 with the support mechanism 5 alone, the support mechanism 5: is configured to move the supporting locations to the seat 3 in the front-rear and right-left direction by combining: the front support structure having the front link 58 configured to directly or indirectly support the bottom surface of the seat 3 at least at two locations in the front-rear direction and the rear support structure having the rear link 59; and the left support structure and the right support structure having the left-right link 55 configured to directly or indirectly support the bottom surface of the seat 3 at two locations in the left-right direction, the supporting locations being configured to draw a trajectory along which the tip side in a movement direction of the seat 3 is downwardly inclined in accordance with the movement; and further includes a return-force generation mechanism configured to generate, in accordance with the amount of movement, the return force in the direction of returning the supporting locations to the seat 3 having moved from the reference position (S) in the front-rear or left-right direction, to the reference position (S).

As a specific mode of an implementation, in the present embodiment, a configuration so that, as the front-rear supporting locations are moved in the front direction by the front-rear links 58, 59 from the reference position (S), the supporting location of the front link 58 is relatively lower than the supporting location of the rear link 59, and as the front-rear supporting locations are moved in the rear direction from the reference position (S), the rear-side supporting location of the seat 3 is relatively lower than the front-side supporting location, is applied. Alternatively, a configuration so that as the left-right supporting locations are moved in the left direction by the left-right links 55 from the reference position (S), the left-side supporting location is relatively lower than the right-side supporting location, and as the left-right supporting locations are moved in the right direction from the reference position (S), the right-side supporting location of the seat 3 is relatively lower than the left-side supporting location, is applied.

Third Embodiment

Next, a third embodiment of the present invention will be described with reference to FIG. 23 to FIG. 26. In each of the above-described embodiments, as a structure allowing the seat 3 to operate forward and rearward or rightward and leftward, the structure based on the relative operation between the guide surfaces 23*a*, 23*b*, 25*a*, 25*b*, and the followers 24*a*, 24*b*, 26*a*, and 26*b*, and the structure based on the operation of the left-right link 55, the front link 58, and the rear link 59 are respectively disclosed. In contrast to these embodiments, in the present embodiment, a joint support, mechanism 6 in which the structure allowing the seat 3 to operate in the front-rear direction is used together with a structure based on a relative operation between the guide surface 25*a* and the follower 26*a* and a structure based on the operation of the rear link 59, is applied. That is, also in the chair according to the present embodiment, the joint support mechanism 6 interposed between the leg 1 and the seat 3 is arranged below the seat 3, and is configured to movably support the seat 3, at least at two locations in the front-rear direction and two locations in the left-right direction, along a predetermined trajectory, the joint support mechanism 6 includes a seat inclining mechanism Q being a seat inclining function, the seat inclining mechanism Q being configured to downwardly incline the tip side in a movement direction of the seat 3 in accordance with the movement of the seat 3, and further includes a return-force generation mechanism configured to generate the return force in the direction of returning the seat 3 having moved from the reference position KS) in the front-rear or left-right direction, to the reference position (S).

The configuration of the chair will be described with a particular focus on a difference from the chair according to the second embodiment.

The chair according to the present embodiment is configured so that a support structure 60 is provided instead of the swing support body 50 in the chair according to the second embodiment, and at the seat receiver 31 side, a front-rear operation unit 67 is provided, instead of the front-rear swing unit 57.

In the support structure 60, the left-right swinging unit 54 similar to that in the second embodiment is provided in a lower-side portion, and the rear link 59 having the same configuration as that in the second embodiment is provided at a rear end of an upper-side portion. Further, the same front follower 26*a* as that in the first embodiment is arranged at the front end of the upper side portion of the support structure 60.

The configuration of the front-rear operation unit 67 is substantially similar to that in the second embodiment in the shape of a pair of left and right front-rear operation units 67 suspended below the seat receiver 31 and in the configuration of connecting to the rear link 59 at the rear end. A difference is that at its front side, the front-rear guide holes 25 for inserting the front follower 26*a*, which is similar to that in the first embodiment, specifically, the front-rear guide holes 25 having the front guide surface 25*a*, out of the front-rear guide holes 25, is formed.

Figure 24:
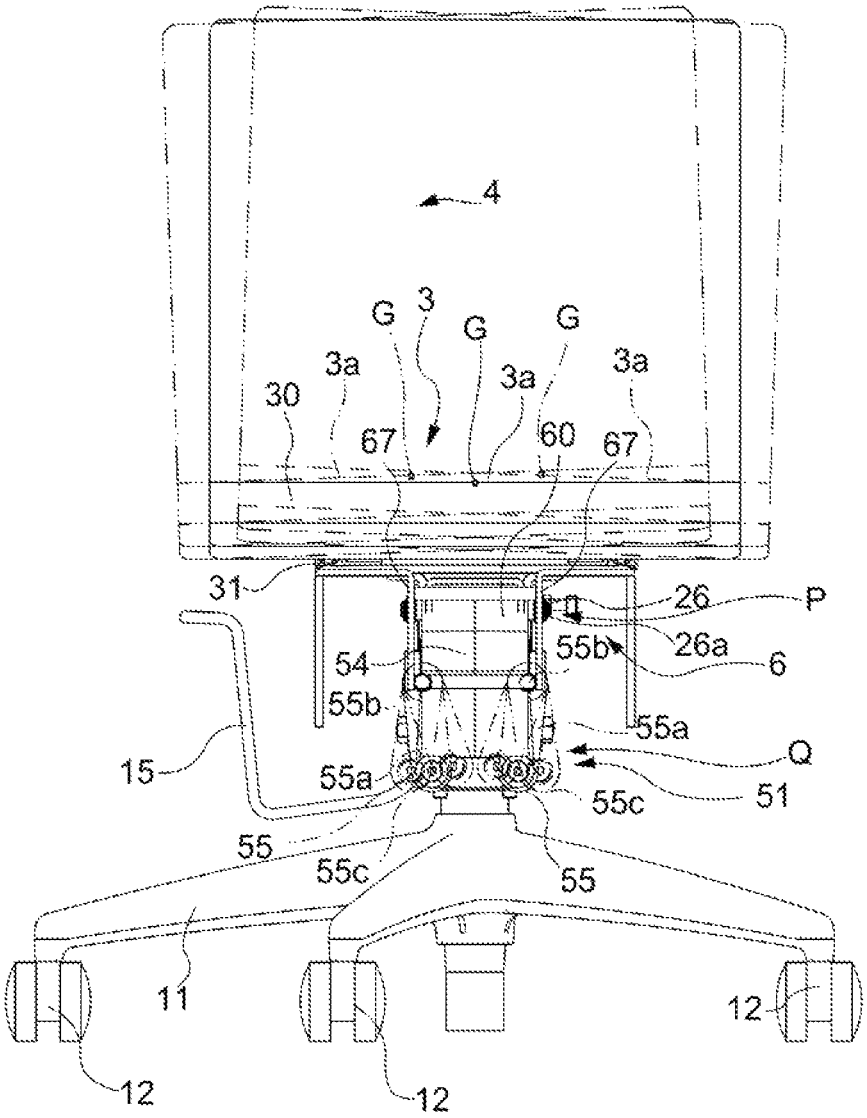
FIG. 24 is a front view according thereto.
Figure 25:
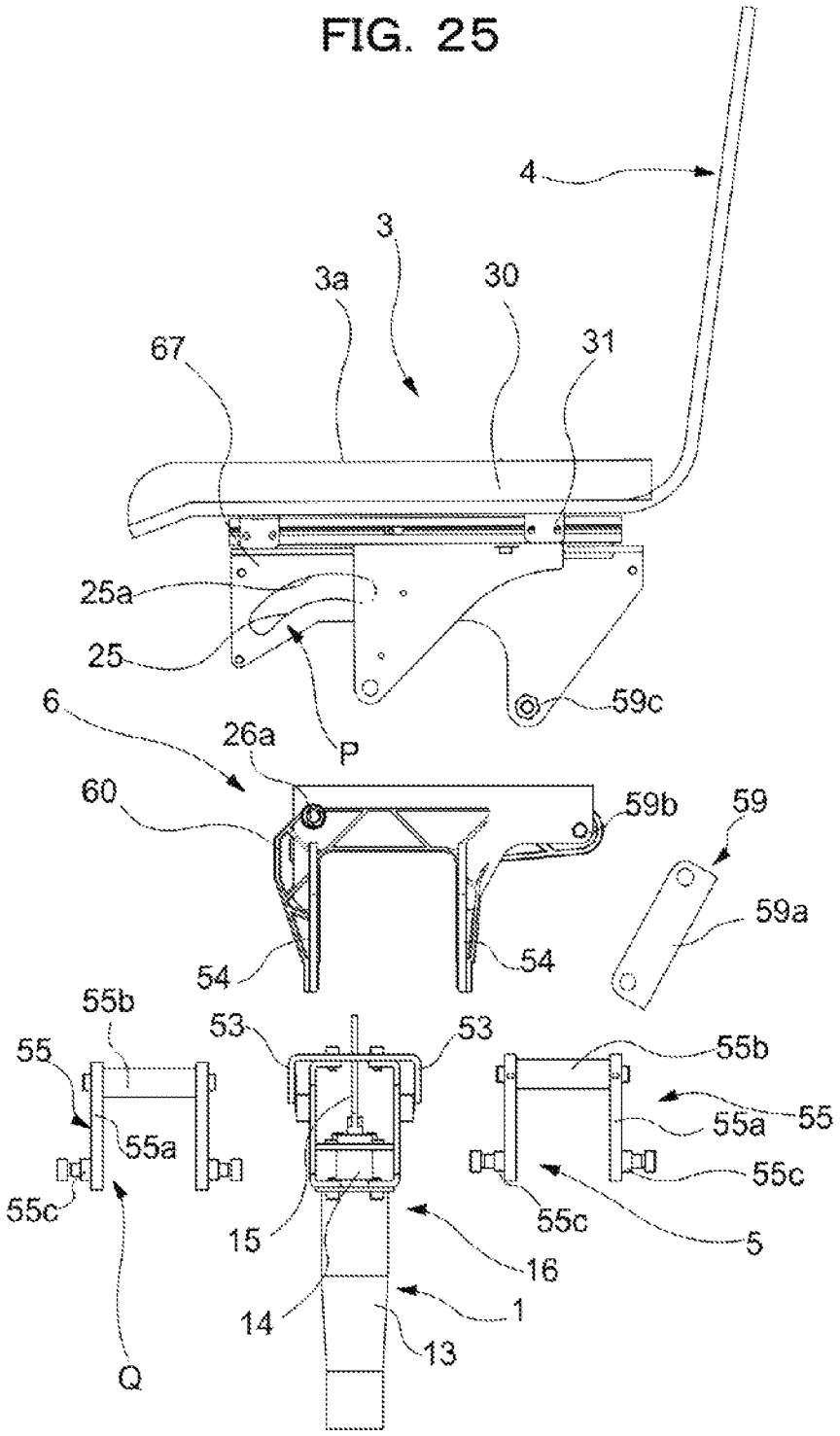
FIG. 25 is an exploded perspective view according thereto.

In addition, a configuration below the support structure 60, in other words, a lower side portion of the chair connected to the left-right swing unit 54 has the same configuration as that in the second embodiment, and thus, a specific configuration thereof will not be described. Further, the configuration of the left-right support unit 51 having the left-right swing unit 54 is also naturally the same as that in the second embodiment, and thus, as illustrated in FIG. 24, the operation of the seat 3 in the left-right direction is similar to that in the second embodiment in FIG. 19. As a result, description about the operation of the seat 3 in the left-right direction illustrated in FIG. 24 will be also omitted.

Further, configuration above the front-rear operation unit 67, that is, the configurations of the seat 3 and the backrest 4 have the same configuration as those in the second embodiment, and thus, detailed description will be omitted.

Figure 26:
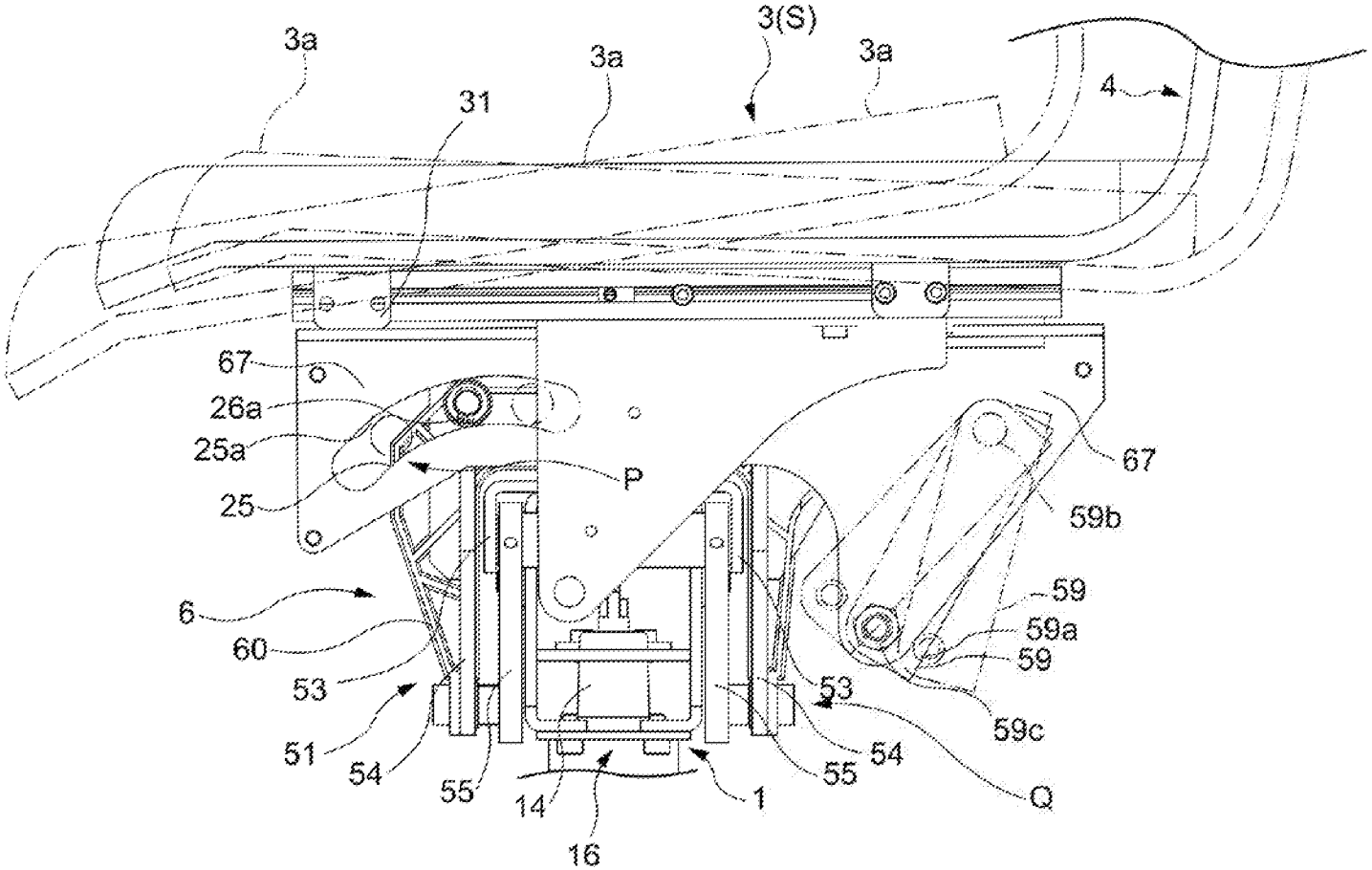
FIG. 26 is operation explanatory diagram according hereto.

Here, in the present embodiment, as illustrated in FIG. 26, a configuration is that the seat 3 may be operated in the front-rear direction by the relative operation between the support structure 60 and the front-rear operation unit 67. Specifically, when the seat 3 is not operated at all, the seat 3 is at the reference position (S) indicated by a solid line where the rear link 59 does not swing but stabilizes by its own weight of the mechanical component, and the front follower 26*a* arranged in the support structure 60 also rests at a corresponding position on the front guide surface 25*a*.

Further, at the reference position (S) indicated by the solid line in FIG. 26, the swingable rear link 59 rests by its own weight of the upper side portion of the chair such as the seat 3 and the backrest 4 to which the rear swing shaft 59*c* is connected. Therefore, when the seat surface 3*a* operates forward and rearward as illustrated in an imaginary line in FIG. 26, its operation is against the gravity. That is, similarly to each of the above-described embodiments, the return force exerted by the gravity in a direction of returning the seat to the reference position (S) is spontaneously applied at the time of the operation of the seat. That is, in the present embodiment, the front follower 26*a*, the front guide surface 25*a*, the rear link 59, out of the return-force generation mechanism, are the front-rear return unit configured to generate return force in the front-rear direction, and function as the center-of-gravity moving mechanism P configured to elevate the center of gravity G of the seat 3 in accordance with the operation of the seat 3 from the reference position (S). In addition, in FIG. 26, the seat surface 3*a* operating forward and rearward takes a posture in which the operation tip side is descended. This results from the posture of the rear link 59 and the shape of the front guide surface 25*a* performing the relative operation with the front follower 26*a* at the front side of the rear link 59. That is, in the present embodiment, the front guide surface 25*a* and the rear link 59 function as the seat inclining mechanism Q.

That is, an effect similar to that in each of the above-described embodiments can be accomplished also with such a configuration according to the third embodiment of the present invention. In particular, in the present embodiment, when the sliding operation by the front follower 20*a* and the swinging operation by the rear link 59 are applied together, it is possible to realize a smooth operation and a high rigidity of the seat 3 at the same time. Needless to say, the present embodiment will not exclude a mode in which a support structure in the front-rear direction of the seat 3 having the front and rear followers 20*a*, 26*b* similar to those in the first embodiment is applied to the upper side of the left-right link 55.

Further, in the present embodiment, a shockless unit R similar to that in each of the above-described embodiments can be also provided at a position at which the front guide hole 25 is provided and a position at which the left-right link 55 is provided.

Fourth Embodiment

A chair according to a fourth embodiment of the present invention may be suitably utilized as a rotating chair as illustrated in FIG. 27 to FIG. 31. The chair is similar to that in the above-described embodiments in that the leg 1 coming in contact with the floor such and the seat 3 provided above the leg 1 are provided. Further, in the present embodiment, for convenience of illustration, in the seat 3, only the seat receiver 31 of sheet form is illustrated; however, the seat 3 similar in mode to the above-described embodiments may be applied. Unlike the seat 3 according to the above-described embodiments, a mode in which the backrest 4 is not integrally provided may be applied to the seat 3, and a conventional configuration may be widely applied to the seat 3.

Further, the leg 1 is similar in configuration to the above-described embodiments other than the configuration in which the rotation support mechanism 16 as a part of the leg 1 configured to rotatably support the seat 3 is not provided, and thus, the description will be omitted. Further, the chair according to the present embodiment is similar to the above-described embodiments in that the support mechanism is configured across the upper end portion of the leg 1 to the seat receiver 31.

However, because the chair according to the present embodiment differs in configuration of the support mechanism from that in the above-described embodiments, the return force generating mechanism and the seat inclining mechanism Q are also configured in a different mode.

That is, the chair according to the present embodiment is similar to that in the above-described embodiments in that it has the support mechanism interposed between the leg 1 and the seat 3, the support mechanism being configured to operatively support the seat 3 by the relative operation between the guide surface and the follower, and the support mechanism including the guide surface formed along a predetermined trajectory along which the seat 3 is operated in the front-mar direction and the left-right direction and the follower configured to perform the sliding operation following the guide surface. A difference is that when the chair is so configured that the guide surface is an integrally formed guide curved surface 83 and a plurality of followers or sliding contact followers 82 can operate in any direction of the front and rear directions and right and left directions along the guide curved surface 83, a guide support mechanism 8 is provided which can serve a role as a rotation support mechanism configured to rotatably support the seat 3 in the horizontal direction, in addition to a role of the support mechanism providing the same effect as in the above-described embodiments.

As illustrated in FIG. 27 to FIG. 30, in order to operatively support the seat 3 along a predetermined trajectory, interposed between the leg 1 and the seat 3, along which the seat is operated in the front-rear direction and left-right direction, the guide support mechanism 8 applies a configuration having a guide board 81 having a guide curved surface 83 of substantially conical shape or truncated cone shape and a sliding contact follower 82 that can slide on the guide curved surface 83 in any direction. This guide support mechanism 8 is configured to be interposed between the upper end portion of the leg 1 and the lower end portion of the seat receiver 31.

The guide board 81 is formed of a hard material fixed at the upper end of the leg 1. The guide board 81 is so shaped that a portion in the vicinity of an outer edge is dented downwardly into a substantially exact circular shape in plan view, and further a portion surrounded by the dented portion is elevated into a substantially truncated cone shape so as to be gradually higher toward a center portion. In addition, the elevated portion formed by denting the portion in the vicinity of the outer edge is configured as a restriction wall 84 configured to restrict an operation range of the sliding contact follower 82, and the curved surface surrounded by the restriction wall 84 is configured as the guide curved surface 83. Specifically, the shape of the guide curved surface 83 has a curved surface shape such that the degree of inclination gradually becomes larger as being closer to the center of the guide board 81 from the vicinity of an outer periphery thereof. Note that in the present embodiment, the center of the guide board 81 is configured in a planar form; however, the sliding contact follower 82 is set to not slide over the planar portion.

In the present embodiment, the sliding contact follower 82 is arranged with respect to the seat receiver 31 at six locations being at least four or more locations allowing for a stable self-standing, so that each location corresponds to a relative position corresponding to each vertex of an equilateral hexagon in planar view. In another words, the sliding contact follower 82 is arranged at a relative position which can be arranged in equal intervals on the outline of the exact circle. The sliding contact follower 82 includes a follower main body 85 having a substantially spherical shape slidingly contacting the guide curved surface 83 and a seat supporting post 80 of which the lower end portion is supported by the follower main body 85 and of which the upper end portion is fixed to the seat receiver 31.

Figure 27:
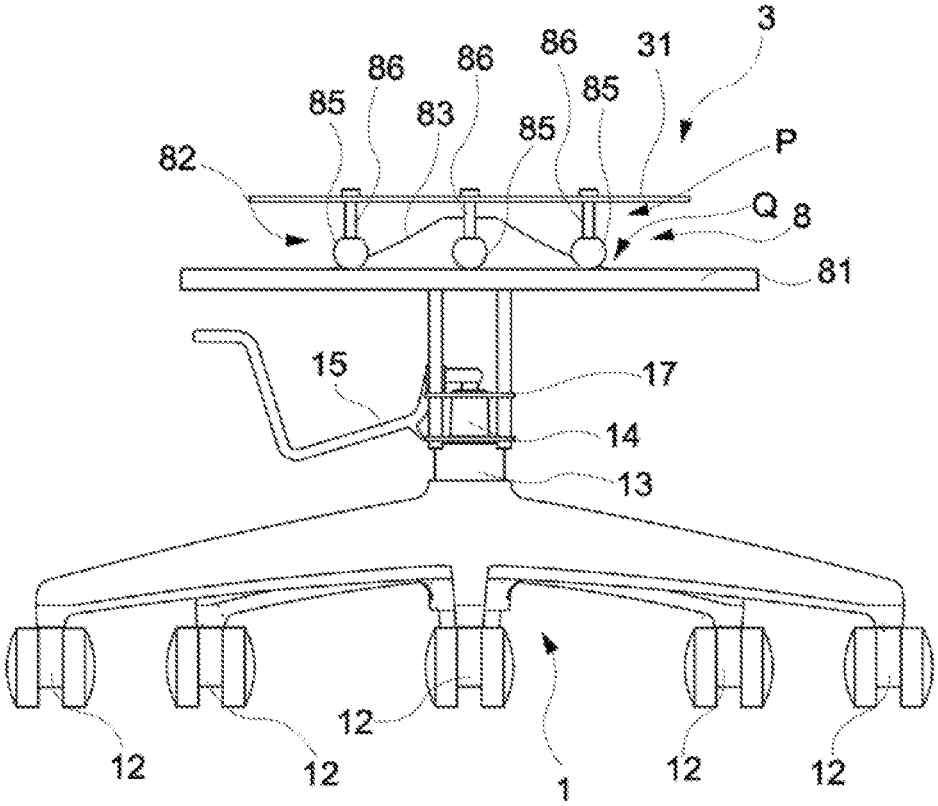
FIG. 27 is a front view according to a fourth embodiment of the present invention.
Figure 28:
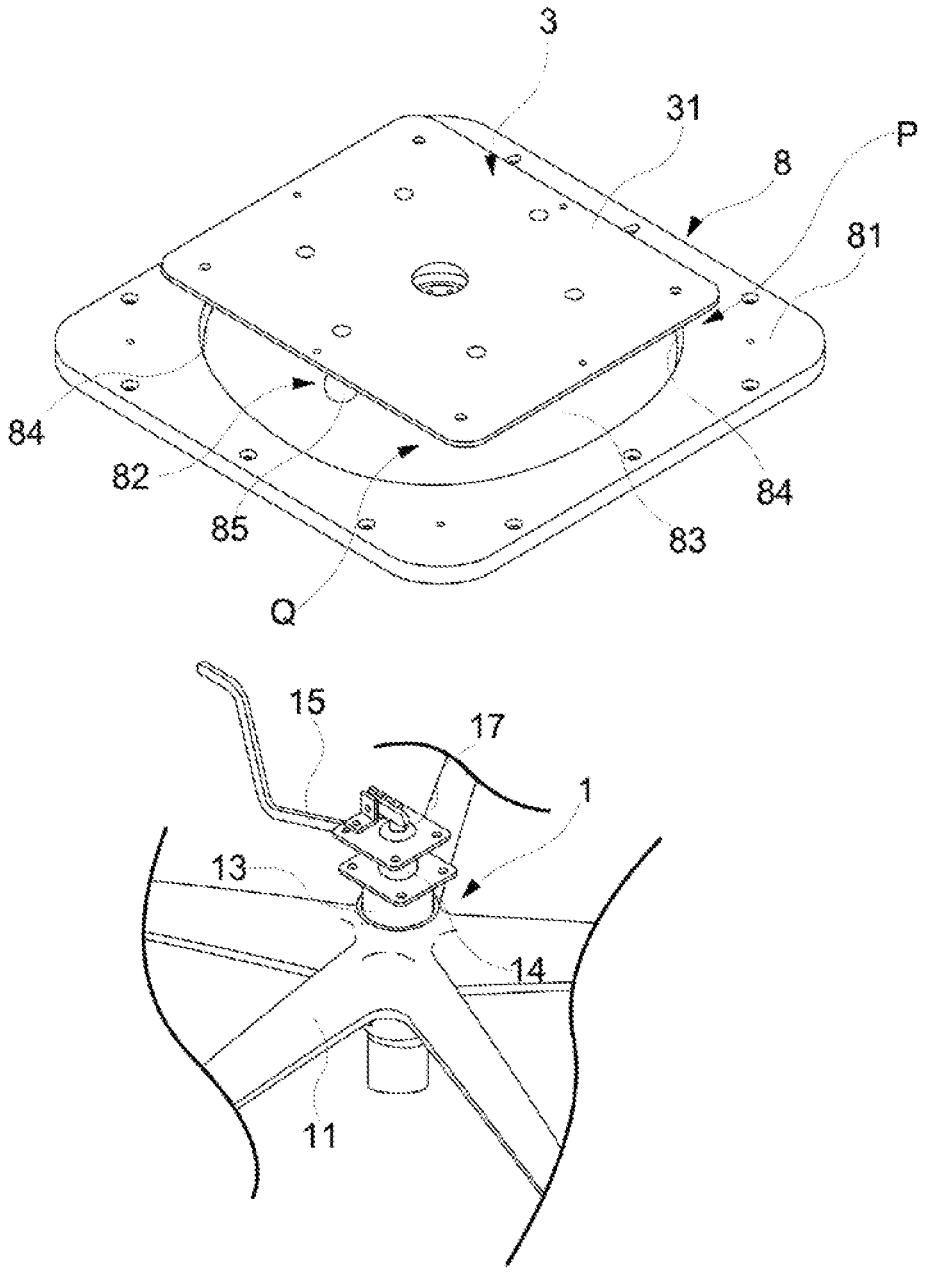
FIG. 28 is an exploded perspective view according thereto.
Figure 29:
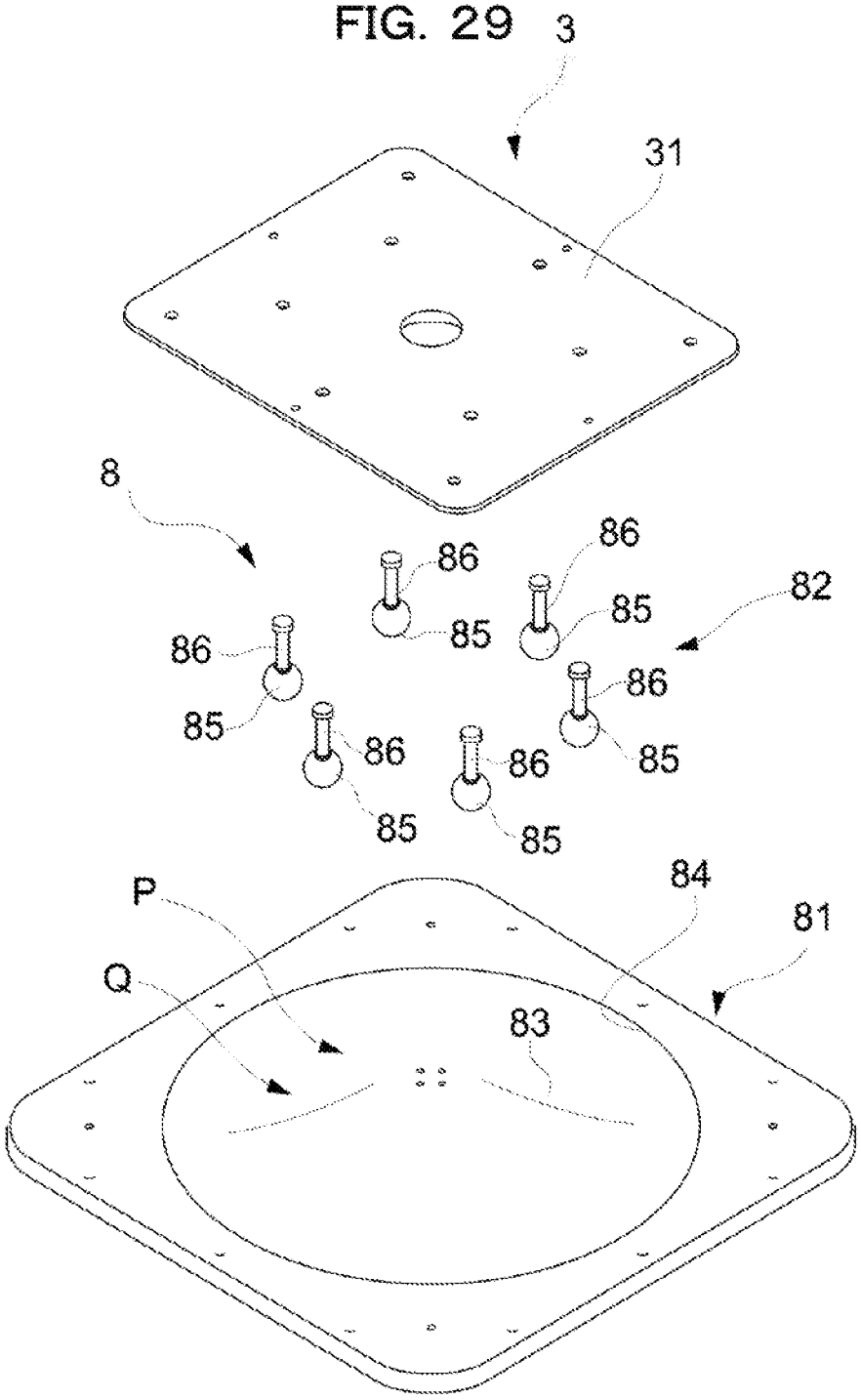
FIG. 29 is an exploded perspective view according thereto.
Figure 30:
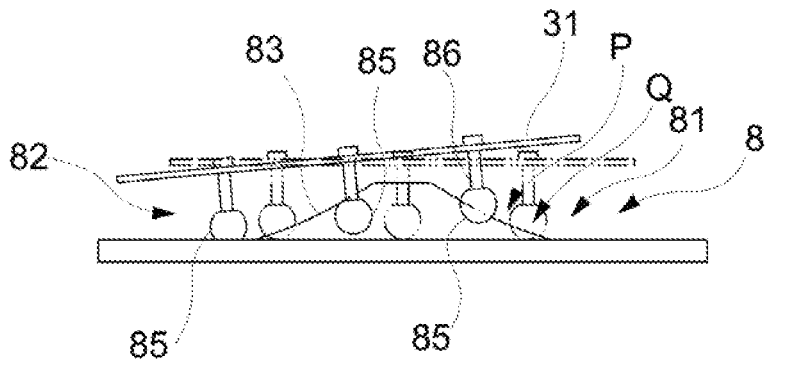
FIG. 30 is an operation explanatory diagram according thereto.
Figure 30:
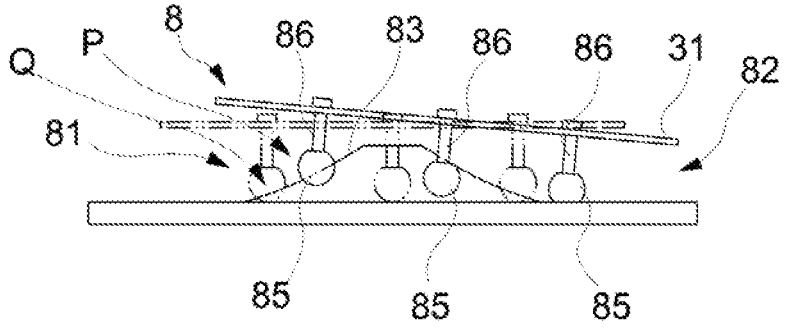

An operation of the seat 3 according to the present embodiment will be described, below. FIG. 27 illustrates the seat receiver 31 only, and FIG. 30 illustrates a behavior of the seat receiver 31 when the seat 3 operates from a predetermined reference position (S) at which the seat 3 rests by its own weight into any direction. In the present embodiment, not only in a state illustrated in FIG. 30, but also when the seat 3 operates from the reference position (S) into any direction, its operation is against the gravity. Specifically, the guide curved surface 83 being a guide surface is provided so that there are always, of the six sliding contact followers 82, some sliding contact followers 82 ascending and the other sliding contact followers 82 descending, during the operation of the seat. As a result, in the configuration of the present embodiment, the position of the center of gravity of the seat receiver 31 rises from the reference position (S). Further, at this time, a return force exerted by the gravity in a direction of returning the seat 3 to the reference position (S) is spontaneously applied to the seat 3. That is, in the present embodiment, the guide curved surface 83 and the sliding contact follower 82 are the return-force generation mechanism and function as the center-of-gravity movement mechanism P configured to elevate the center of gravity G of the seat 3 in accordance with the operation of the seat 3 from the reference position (S). In addition, the seat receiver 31 that has operated is in a posture in which the operation tip side is descended. As described above, this results from the feature that the guide curved surface 83 is in a substantially truncated cone shape. That is, in the present embodiment, the guide curved surface 83 also functions as the seat inclining mechanism Q.

Modification

Figure 31:
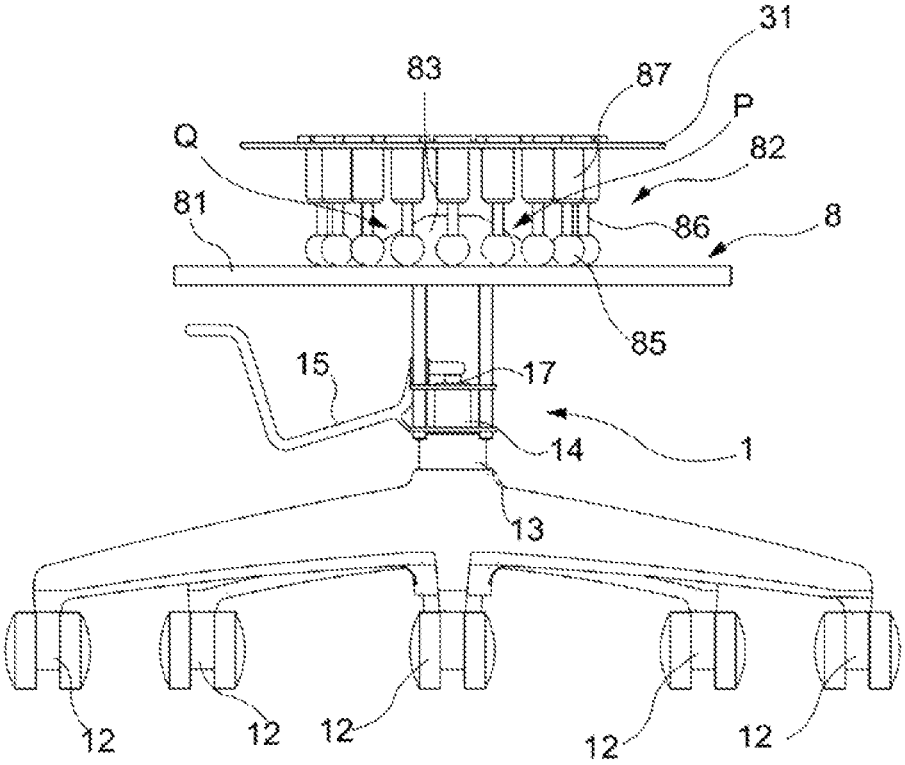
FIG. 31 is a front view according to a modification of the fourth embodiment.

In the above-described present embodiment, a mode is disclosed in which each of the six sliding contact followers 82 is firmly fixed to the seat receiver 31; however, as illustrated in FIG. 31, needless to say, a spring 87 may be separately arranged in the sliding contact follower 82.

In the present modification, in addition to the follower main body 85 and the seat supporting post 86 similar to those in the above-described embodiment, the sliding contact follower 82 further includes a spring 87 interposed between the seat supporting post 86 and the seat receiver 31. In the spring 87, a pressure coil spring of which the upper end portion is fixed to the seat receiver 31 side and the lower end portion is fixed to the upper end portion of the seat supporting post 86, is installed. This results in a shock applied to the seated person during sitting being relieved, and contributes to smoother operation of the seat 3.

Further, as illustrated in FIG. 31, needless to say, the number of the sliding contact followers 82 is not limited to six, and seven or more sliding contact followers 82 may be arranged concentrically. It is noted that in the modification, 18 sliding contact followers 82 are arranged concentrically.

According to the configuration as described above, when the chair according to the present embodiment and the modification is configured to conform to the first to third embodiments, it is possible to accomplish an operation and effect similar to those in the first embodiment.

In particular, in the present embodiment, when it is so configured that the guide surface is the integrally formed guide curved surface 83, and a plurality of followers or the sliding contact followers 82 can freely contact slidingly along the guide curved surface 83 in any direction of the front and rear directions and the left and right directions, that is, at least at two locations in a front-rear direction and two locations in a left-right direction, in any direction, it is possible to integrally configure the support mechanism similar to that in the above-described embodiments and the rotation support mechanism similar to the rotation support mechanism 16 that is one constituent element of the leg 1 in the above-described embodiments to realize a compact chair as a whole.

In addition, in the present embodiment, when there are a plurality of sliding contact followers 82, specifically, four or more sliding contact followers 82, and the guide curved surface 83 is set so that there are always, of the plurality of sliding contact followers 82, some sliding contact followers 82 ascending and the other sliding contact followers 82 descending, during the operation of the seat 3, it is possible to more simply configure the center-of-gravity movement mechanism P similar to that in the above-described embodiments.

In addition, in the present embodiment, a smooth operation of the seat 3 can be realized by configuring so that the guide curved surface 83 being a guide surface has a substantially conical shape.

In particular, in the present embodiment, when it is so configured that the sliding contact follower 82 always contacts the guide curved surface 83 at three or more locations, the sliding contact follower 82 stably contacts the guide curved surface 83, as a result of which it is possible to stably support the seat receiver 31 and the seat 3 as well.

Fifth Embodiment

Figure 32:
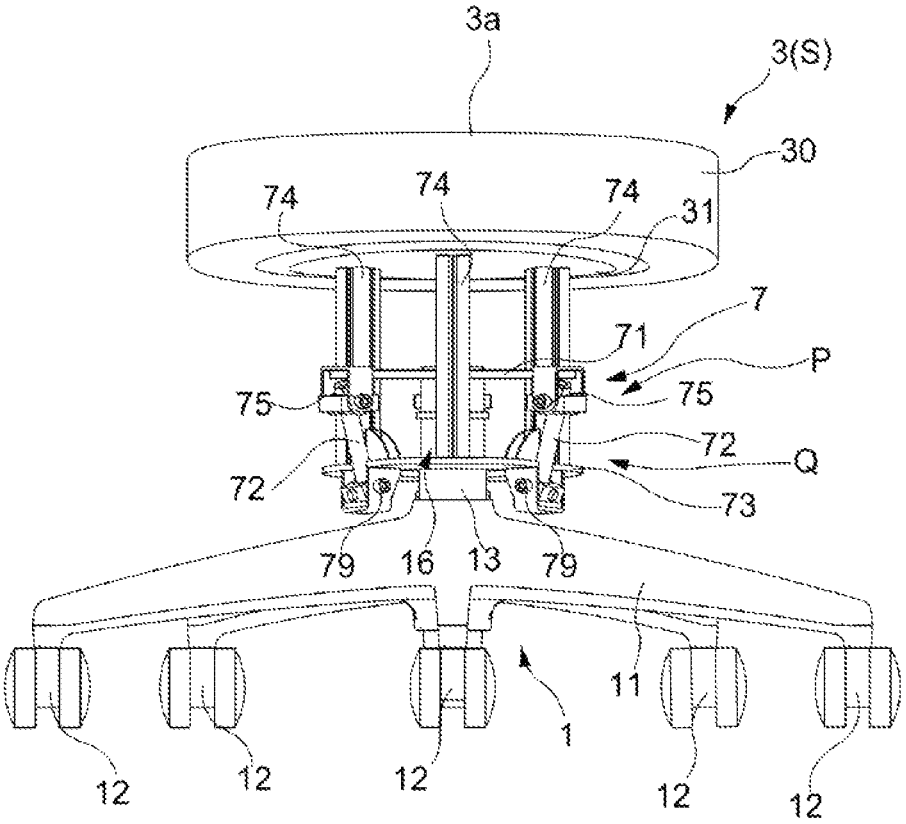
FIG. 32 is an appearance diagram according to a fifth embodiment of the present invention.
Figure 33:
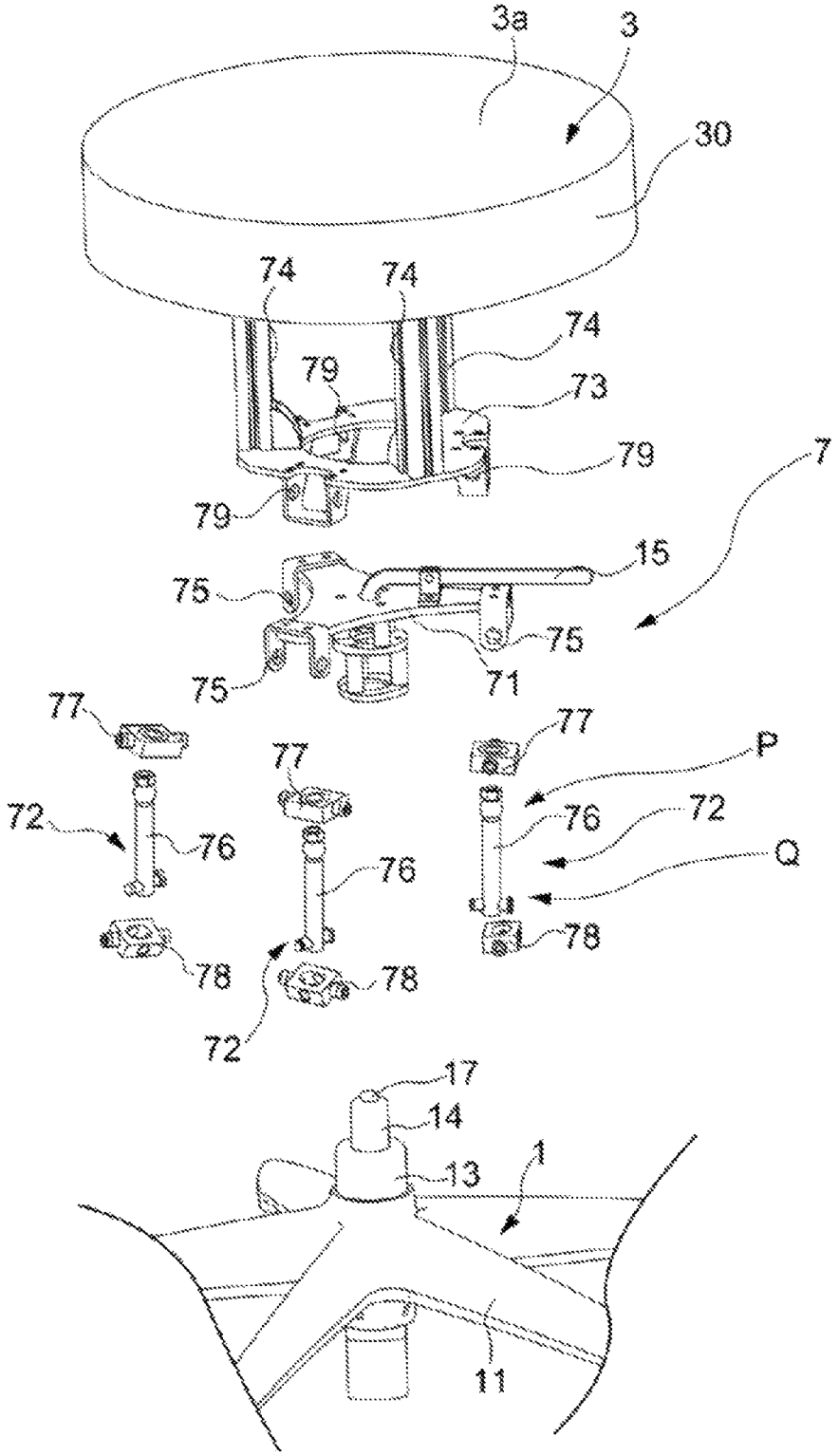
FIG. 33 is an exploded perspective view according thereto.
Figure 34:
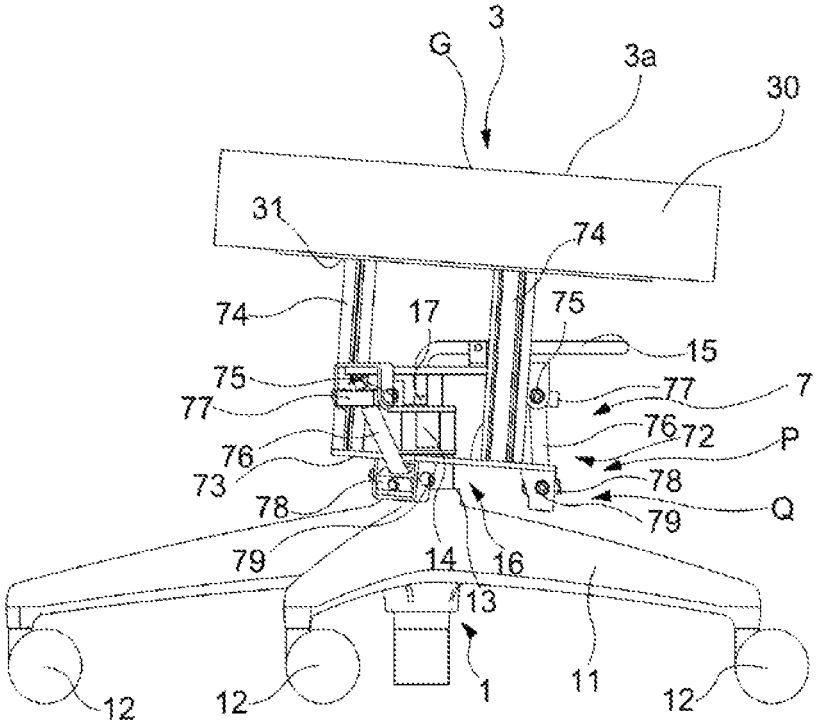
FIG. 34 is an operation explanatory diagram according thereto.

As illustrated in FIG. 32 to FIG. 34, in a chair according to a fifth embodiment of the present invention, the illustration of the backrest 4 is omitted to clarify the configuration of the seat 3 and the position of the seat surface 3*a*; however, it is not intended to exclude assembling of the backrest 4.

The chair is similar to that in the above-described embodiments in that the leg 1 coming in contact with the floor surface and the seat 3 provided above the leg 1 are provided. Further, the seat 3 has a substantially exact circular shape in planar view different from that in the above-described embodiments, and the backrest 4 is not integrally formed as described above. However, the configuration of the seat 3 is similar to that in the above-described embodiments and the conventional configuration in that the seat main body 30 is used as a main body while the top surface side is the seat surface 3*a* and the seat receiver 31 is provided on the bottom surface side.

Further, the leg 1 has a configuration similar to that in the above-described embodiments, and thus, description will be omitted. The chair according to the present embodiment is similar to that in the embodiments described above in that the support mechanism is configured across the upper end portion of the leg 1 to the lower end portion of the seat receiver 31.

However, in the chair according to the present embodiment, when the configuration of the support mechanism is differed from that in the above-described embodiments, the return-force generation mechanism and the seat inclining mechanism Q are configured in a different mode.

That is, the chair according to the present embodiment is common to the above-described second embodiment in that the suspension support mechanism configured to operatively support the seat 3 at least in the front-rear direction and the left-right direction along a predetermined trajectory by suspending a part of the seat 3 from a part of the leg 1 from above is the link mechanism including the link member extending in the up-down direction. However, the chair according to the present embodiment is different from the suspension support mechanism according to the above-described embodiment in that the link member is a both-end universal joint 72 being a universal joint of which the both ends are operatively supported both in the front-rear direction and in the left-right direction. Further, in the present embodiment, when a joint support: mechanism 7 allowing the seat 3 and the leg 1 to be coupled via the both-end universal joints 72 is provided, the seat 3 is configured to be operable in the front-rear direction and the left-right direction.

Here, in the present embodiment, when the joint support mechanism 7 is so configured that there are four or live or more both-end universal joints 72 being link members, and the seat 3 is supported movably, at least at two locations in the front-rear direction and two locations in the left-right direction, along a predetermined trajectory, a mode in which the chair according to the present invention is suitably configured is described; however, in particular, to clearly illustrate and describe a detailed configuration of the both-end universal joints 72, for convenience, FIG. 32 to FIG. 34 illustrate a chair with the three both-end universal joints 72 or link members.

That is, as illustrated in FIG. 32 to FIG. 34, the joint support mechanism 7 is interposed between the leg 1 and the seat 3, and applies a link mechanism having, for convenience in FIG. 32 to FIG. 34, three both-end universal joints 72 being link members extending in the up-down direction so that the seat 3 is supported at least at two locations in the front-rear direction and two locations in the left-right direction and the seat 3 can be operatively supported along a predetermined trajectory along which the seat 3 is operated.

The joint support mechanism 7 includes a suspension board 71 provided in an upper end portion of the leg 1, the both-end universal joints 72 of which the upper end portion is connected to the suspension board 71, a swing board 73 connected to a lower end portion of the both-end universal joints 72, and a seat support post 74 erected on the swing board 73 and configured to support the seat 3 at a height position higher than the suspension hoard 71.

The suspension board 71 is fixed to a horizontally rotatable location at the upper end of the leg 1 by the rotation support mechanism 16 provided in the leg 1 and forms an annular shape in planar view around the leg supporting post 13. In the suspension board 71, portions at three locations on the outside are suspended, and the suspended portions are punched with an upper connection hole 75 for connecting to the upper end of the both-end universal joints 72.

In the both-end universal joints 72 being thine link members, the upper end portion is attached to be suspended down from the upper connection hole 75 of the suspension board 71, and the lower end portion is connected to the swing board 73. The both-end universal joints 72 includes a joint main body 76 extending in the up-down direction, an upper connection unit 77 configured at the upper end of the joint main body 76, the upper connection unit being pivotally attached onto the suspension board 71, and a lower connection unit 78 configured at the bottom end of the joint, main body 78, the lower connection unit being pivotally attached onto the swing board 73. In the three both-end universal joints 72 being link members, a distance between the lower connection units 78 provided at the lower end is set to be shorter than a distance between the upper connection units 77 provided at the upper end.

The swing board 73 is a board-like shape of an annular shape in planar view around the leg supporting post 13 suspended and supported onto the suspension board 71 via the both-end universal joints 72, and includes a lower connection hole 79 configured to connect to the lower connection unit 78 provided at the lower end of the both-end universal joints 72 at three locations on the outer circumference surface.

The seat support post 74 is configured so that the lower end portions are each fixed at three locations on the top surface of the swing board 73, it stands upwardly in a substantially vertical direction at the reference position (S) at which the seat 3 does not make any operation, and the upper end portions are fixed to the seat receiver 31. That is, the seat 3 is configured so that the vertical thicknesses are substantially constant as illustrated, and thus, the top surface of the swing board 73 and the seat surface 3*a* are configured to substantially face each other. Further, the seat support 74 is arranged at a substantially intermediate position between the both-end universal joints 72, so that when the seat 74 operates, it does not interfere with the both-end universal joints 72 itself and the operation thereof.

All operation of the seat according to the present embodiment will be described, below. FIG. 32 illustrates a predetermined reference position (S) at which the seat 3 rests by its own weight, and FIG. 34 illustrates a behavior of the seat 3 when the seat 3 operates into any direction. Not only in a state illustrated in FIG. 34, but also when the seat 3 operates from the reference position (S) into any direction, its operation is against the gravity. Specifically, when any or all of the lower connection units 78 provided at the lower end of the both-end universal joints 72 are elevated, the position of the center of gravity G of the seat surface 3*a* rises from the reference position (S). At this time, the return force exerted by the gravity in a direction of returning the seat to the reference position (S) is spontaneously applied to the seat. That is, in the present embodiment, the both-end universal joint 72 is the return-force generation mechanism, and functions as the center-of-gravity movement mechanism P configured to elevate the center of gravity G of the seat 3 in accordance with the operation of the seat 3 from the reference position (S). In addition, as illustrated in FIG. 34, the seat surface 3*a* that has operated takes a posture in which the operation tip side is always descended. This results from the feature, as described above, that the distance between the lower connection units 78 provided at the lower end of the both end universal joints 72 is set to be shorter than the distance between the upper connection units 77 provided at the upper end of the both-end universal joints 72. That is, in the present embodiment, the both-end universal joint 72 also functions as the seat inclining mechanism Q.

As described above, also in accordance with the fifth embodiment of the present invention, when it is so configured to conform to the first to third embodiments, it is possible to accomplish the operation and effect similar to those in the above-described embodiments.

In particular, in the present embodiment, as a mode of the suspension support mechanism, the link members are configured as the both-end universal joints 72 of which the both ends are pivotably supported in both the front-rear direction and right-eft direction, and the seat and the leg 1 are coupled via the both-end universal joints 72. This enables a more flexible operation which can further improve the followability to the movement of the seated person.

Further, in the present embodiment, when a plurality of both-end universal joints 72 being link members are arranged so that the up-and-down positions overlap at a position surrounding the center of the seat 3 in planar view, a chair configured to be more compact in the up-down direction is realized.

Further, in the present embodiment, when the configuration is applied in which the seat 3 is suspended by the three both-end universal joints 72 being link members, it is possible to minimize wobbling of the supported seat 3 while obtaining the effect and operation that conforms to the present invention, as a result of which the seated person is given a more comfortable sitting feeling.

As described above, in the present embodiment, for convenience of the detailed description and the illustration of the single both-end universal joint 72, the configuration of suspending the seat 3 by the three both-end universal joints 72 being link members is applied. However, originally, the chair according to the present embodiment is configured so that the four or five or more both-end universal joints 72 being link members are provided to realize a more stable support for the seat 3.

That is, in the present invention, it is so configured that there are four or five or more both-end universal joints 72 or link members and the seat 3 is supported movably, at least at two locations in a front-rear direction and two locations in a left-right direction, along a predetermined trajectory. In this way, the chair according to the present invention is suitably realized.

Further, the embodiment is not, of course, limited to a mode in which the seat is suspended by the both-end universal joints being plurality of link members. In other words, a mode in which the seat is supported from below by the both-end universal joints shall not be precluded from the present invention.

Thus, an embodiment of the present invention has been described, and a specific configuration of each unit is not limited to that in the embodiments described above and various modifications are possible without departing from the gist of the present invention.

For example, in the above-described embodiments, only a mode in which the backrest is provided integrally with the seat is disclosed; however, naturally, a mode in which the backrest is provided separately from the seat, and a mode in which while the seat and the backrest are provided separately, a synchro-tilt mechanism in which the backrest may operate in response to the operation of the seat are provided may also be acceptable. In particular, when the backrest is provided in the front-rear support unit and/or the seat, it is possible to obtain the synchro-tilt mechanism with a simple configuration.

Further, a bending function of bending the front portion of the seat may be provided, and in association with the front-rear support unit, the seat may be supported at three locations in the front-rear direction.

Further, although an elbow is not disclosed in each of the embodiments described above, of course, provision of the elbow shall not be precluded in each of the embodiments described above. In particular, in a case of a chair directly or indirectly provided with the elbow in the vicinity of the upper end of the leg, the elbow does not operate forward, rearward, rightward, and leftward in conjunction with the operation of the seat, and thus, a further sense of safety can be given to the seated person.

In addition, gall of the embodiments described above disclose the center-of-gravity movement mechanism P as the configuration of the return-force generation mechanism, and naturally, provision of an elastic means such as a spring shall not be precluded as long as it is configured to return the seat to the reference position.

Further, a "buffer means" configured to buffer a bumping feeling upon reaching the operation end of the seat may be provided between the seat or the backrest, and the support mechanism, or within the support mechanism. Specific examples include a buffer member provided either in a contact unit provided on the bottom surface side of the seat or on a unit to be contacted provided on an outer wall of the support mechanism, and an elastic member being provided at the end of the guide holes in the support mechanism and coming in contact with a follower.

Further, in each of the above-described embodiments, the seat is held at the reference position by exclusively using its own weight of the seat; however, a "reference position holding means" may be provided so that any reference position can be set. A specific example may include a balancer, provided in the seat, for adjusting a position of the center of gravity of the seat. Further, a lock means configured to lock the seat at the reference position when the seated person does not sit and to unlock the seat when the seated person sits may be provided as a part of the support mechanism. With such a means, the seated person may easily sit on the seat at the reference position while suppressing, undesirable swinging of the seat before sitting, and the seated person may obtain a desirable sitting comfort as a result of being unlocked by sitting.

In addition, it is possible to apply various modifications to another detailed configuration such as a specific shape or material of the seat without departing from the gist of the present invention.

INDUSTRIAL APPLICABILITY

The present invention can be applied to a chair suitably applicable to an office rotating chair and the like.

DESCRIPTION OF REFERENCE NUMERALS

1 Leg
12 Caster
16 Rotation support mechanism
2 Support mechanism
21 Left-right support unit
22 Front-rear support unit
3 Seat
4 Backrest
5 Support mechanism
51 Left-right support unit
52 Front-rear support unit
G Center of gravity
P Return-force generation mechanism (center-of-gravity movement mechanism)
Q Seat inclining function (seat inclining mechanism)
R Shockless unit
S Reference position

The invention claimed is:

1. A chair comprising: a leg erected on a floor surface;

a seat arranged above the leg; and a support mechanism interposed between the leg and the seat, wherein the support mechanism is arranged below the seat, and is configured to movably support the seat, at least at two locations in a front-rear direction and two locations in a left-right direction, along a predetermined trajectory, the support mechanism comprises: a seat inclining function configured to downwardly incline a tip side in a movement direction of the seat regardless of whether the seat moves in the front, rear, left, or right directions in accordance with movement of the seat from a predetermined reference position, and the support mechanism further comprises: a return-force generation mechanism configured to generate a return force, in accordance with an amount of movement from the reference position by raising the center of gravity of the seat regardless of whether the seat moves in the front, rear, left or right direction.

2. The chair according to claim 1, wherein the leg comprises a lifting up and down mechanism, the seat is arranged above the lifting up and down mechanism, and the support mechanism is interposed between the lifting up and down mechanism and the seat.

3. The chair according to claim 1, wherein the support mechanism supports the seat independently and operatively, in each of at least the front-rear direction and the left-right direction, along the predetermined trajectory.

4. The chair according to claim 1, wherein an operation angle and an operation distance of the seat in the front-rear direction are set so as to be larger than that in the left-right direction.

5. The chair according to claim 4, wherein the operation angle of the seat in a rear direction is set to be larger than that in a front direction.

6. The chair according to claim 1, wherein the return-force generation mechanism is a center-of-gravity movement mechanism configured to elevate a center of gravity of the seat in accordance with an operation of the seat from the reference position.

7. The chair according to claim 1, comprising a rotation support mechanism configured to support the seat horizontally rotatably with respect to the leg.

8. The chair according to claim 1, wherein the support mechanism comprises a front-rear support unit configured to operatively support the seat in a front-rear direction, and a left-right support unit configured separately from the front-rear support unit, the left-right support unit configured to operatively support the seat in a left-right direction; and the return-force generation mechanism comprises a front-rear return unit configured to generate a return force in a front-rear direction, and a left-right return unit configured separately from the front-rear return unit, the left-right return unit configured to generate a return force in a left-right direction.

9. The chair according to claim 8, wherein the front-rear support unit and the left-right support unit overlap at an overlapping position in planar view.

10. The chair according to claim 8, wherein the front-rear support unit and the left-right support unit are arranged to overlap in an up-down direction.

11. The chair according to claim 8, wherein the front-rear support unit is arranged above the left-right support unit.

12. The chair according to claim 8, wherein a backrest is attached to the front-rear support unit.

13. The chair according to claim 1, wherein the support mechanism comprises a guide surface formed along the predetermined trajectory and a follower configured to move along the guide surface.

14. The chair according to claim 13, wherein the support mechanism comprises at least either a slowing portion configured to slow an operation of the follower in accordance with its closeness to an operation end of the follower or a shockless unit configured to absorb a shock caused by a collision between an end of the guide surface and the follower at the operation end.

15. The chair according to claim 13, wherein the support mechanism comprises a link member in which the operation end is operable along the predetermined trajectory.

16. The chair according to claim 1, wherein the support mechanism comprises a link member allowing an operation end to operate along the predetermined trajectory.

17. A seat support mechanism, wherein the seat support mechanism is configured to move supporting locations to a seat to the front, rear, right, and left by combining: a front support structure and a rear support structure configured to directly or indirectly support a bottom surface of the seat at least at two locations in a front-rear direction; and a left support structure and a right support structure configured to directly or indirectly support the bottom surface of the seat at two locations in a left-right direction, the supporting locations being configured to draw a trajectory along which a tip side in a movement direction of the seat is downwardly inclined in accordance with the movement regardless of whether the seat moves in the front, rear, left, or right direction, and the seat support mechanism further comprises: a return-force generation mechanism configured to generate a return force, in accordance with an amount of the movement from the reference position by raising the center of gravity of the seat regardless of whether the seat moves in the front, rear, left or right direction.

18. The seat support mechanism according to claim 17, wherein the support mechanism comprises a guide surface formed along the trajectory and a follower configured to move along the guide surface.

19. The seat support mechanism according to claim 18, comprising at least either a slowing portion configured to slow an operation in accordance with its closeness to the tip side in the movement direction of the seat or a shockless unit configured to avoid a shock caused by a collision between members at an operation end of the seat.

20. The seat support mechanism according to claim 17, wherein the support structure comprises the link member configured to support the seat along the trajectory.

* * * * *